US012604950B2

(12) United States Patent
Huang

(10) Patent No.: US 12,604,950 B2
(45) Date of Patent: Apr. 21, 2026

(54) FINGER SPINNER RING

(71) Applicant: DaYing Huang, Dongguan City (CN)

(72) Inventor: DaYing Huang, Dongguan City (CN)

( * ) Notice: Subject to any disclaimer, the term of this patent is extended or adjusted under 35 U.S.C. 154(b) by 0 days.

(21) Appl. No.: 19/347,752

(22) Filed: Oct. 2, 2025

(65) Prior Publication Data

US 2026/0096636 A1 Apr. 9, 2026

Related U.S. Application Data

(63) Continuation-in-part of application No. 29/998,995, filed on Apr. 16, 2025, now Pat. No. Des. 1,107,130.

(30) Foreign Application Priority Data

Oct. 9, 2024 (CN) ..... 202430635257.9

(51) Int. Cl.
*A44C 9/00* (2006.01)

(52) U.S. Cl.
CPC ..... *A44C 9/0053* (2013.01)

(58) Field of Classification Search
CPC ..... A44C 9/003; A44C 9/0015; A44C 9/0007; A44C 9/00; A44C 17/0258; A44C 25/00; A44C 25/007; A44C 9/0053
USPC ..... 446/236, 266
See application file for complete search history.

(56) References Cited

U.S. PATENT DOCUMENTS 1,586,606 A * 6/1926 Cain ..... A44C 9/003 63/15.4
2,128,644 A * 8/1938 Gittler ..... A44C 9/0015 63/15
2,812,604 A * 11/1957 Nelson ..... G09D 3/04 63/15.3
4,226,094 A * 10/1980 Wolpoff ..... A44C 9/003 63/15.4
5,161,392 A * 11/1992 Wiriath ..... A44C 5/0092 63/15.7
5,228,316 A * 7/1993 Meyrowitz ..... A44C 17/0258 63/15.4
5,417,085 A * 5/1995 Regev ..... A44C 9/003 63/15.3
5,678,428 A * 10/1997 Pasquetti ..... A44C 9/003 63/15.1
5,873,265 A * 2/1999 Simonnet ..... A44C 17/0241 63/31
6,101,843 A * 8/2000 Nagano ..... A44C 9/003 63/15.3

(Continued)

FOREIGN PATENT DOCUMENTS

CN 210938734 U * 7/2020
CN 212938390 U * 4/2021

(Continued)

*Primary Examiner* — Jason W San
*Assistant Examiner* — Anna S Rashid
(74) *Attorney, Agent, or Firm* — Ying-Ting Chen

(57) ABSTRACT

A finger spinner ring includes a rigid inner rolling ring and an outer flexible ring, the inner rolling ring includes an inner finger wearing ring having a finger passage and an outer ring element rotatably mounted on the inner finger wearing ring, wherein the outer flexible ring is detachably mounted on the outer ring element for being driven to rotate along with the outer ring element, wherein the outer ring element is located between the inner finger wearing ring and the outer flexible ring.

18 Claims, 31 Drawing Sheets

(56) References Cited

U.S. PATENT DOCUMENTS 6,406,349 B1 * 6/2002 Chung ..... A63H 1/04 446/233
6,701,618 B2 * 3/2004 Gefen ..... B22D 25/026 63/15
6,857,289 B1 * 2/2005 Cheng ..... A44C 17/0275 63/26
7,536,874 B2 * 5/2009 Ray ..... A44C 17/0258 63/29.1
7,950,251 B2 * 5/2011 Silvant ..... A44C 9/003 63/15.4
8,082,687 B2 * 12/2011 Cohen ..... G09F 19/02 446/256
8,636,624 B2 * 1/2014 Liberman ..... A63H 33/00 482/148
9,215,913 B2 * 12/2015 Bisserier ..... A44C 9/00
9,380,843 B2 * 7/2016 Logian ..... A44C 25/001
D801,209 S * 10/2017 Herman ..... D11/20
D819,482 S * 6/2018 Herman ..... D11/20
10,088,806 B2 * 10/2018 Vuille ..... G04B 19/286
10,251,456 B2 * 4/2019 Heinz ..... A44C 9/0015
10,646,009 B2 * 5/2020 Song ..... C22C 29/02
10,653,215 B2 * 5/2020 Guirguis ..... A44C 27/001
10,736,386 B1 * 8/2020 Hutchins ..... A44C 15/0025
11,058,192 B2 * 7/2021 Cluseau ..... A44C 9/003
11,197,522 B2 * 12/2021 Hall ..... A44C 25/007
11,224,268 B2 * 1/2022 Berger ..... A44C 9/003
11,490,698 B2 * 11/2022 Derrig ..... B23K 1/0008
11,659,901 B2 * 5/2023 Kim ..... A44C 9/0053 63/15.1
11,717,064 B1 * 8/2023 Kale ..... A44C 9/0053 63/15
D1,000,620 S * 10/2023 Qiu ..... D21/468
12,383,030 B2 * 8/2025 Zeng ..... A44C 5/02
2001/0020369 A1 * 9/2001 Hirano ..... A44C 9/003 63/15.4
2005/0233674 A1 * 10/2005 Torres ..... A63H 1/02 446/236
2006/0048542 A1 * 3/2006 Barry ..... A44C 9/00 63/15.7
2006/0090511 A1 * 5/2006 Boone ..... A44C 9/0015 63/15.1
2008/0194173 A1 * 8/2008 Tiefel ..... A63H 1/04 446/236
2010/0024481 A1 * 2/2010 Rothstein ..... A44C 9/00 63/15.7
2014/0227940 A1 * 8/2014 Jones ..... G09F 19/08 446/236
2017/0035161 A1 * 2/2017 Malo ..... A44C 9/003
2017/0332746 A1 * 11/2017 Krainz ..... A44C 9/0023
2018/0200638 A1 * 7/2018 Chin ..... A63H 37/00
2018/0289118 A1 * 10/2018 Guirguis ..... A44C 9/00
2019/0174885 A1 * 6/2019 Tata ..... A44C 9/003
2019/0191829 A1 * 6/2019 Baker ..... A44C 9/00

FOREIGN PATENT DOCUMENTS

CN 113594819 A * 11/2021 ..... B64G 1/22
CN 112670710 B * 7/2023

* cited by examiner

FINGER SPINNER RING

CROSS REFERENCE OF RELATED APPLICATION

This application is a Continuation-In-Part application that claims the benefit of priority under 35U.S.C. § 120 to a non-provisional application, application Ser. No. 29/998,995, filed on Apr. 16, 2025; this application is also a non-provisional application that claims priority under 35 U.S.C. § 119 to China application number CN202430635257.9, filed on Oct. 9, 2024, wherein the entire content of which is expressly incorporated herein by reference.

BACKGROUND OF THE PRESENT INVENTION

Field of Invention

The present invention relates to a finger toy, and more particularly to a finger spinner ring for children and teenagers.

Description of Related Arts

Fidget toys are small handheld devices designed to occupy the hands and provide sensory stimulation, often used to help children, teenagers, and adults relieve stress, improve focus, or manage restless energy. These toys come in a variety of forms, including spinner rings, rolling rings, stress balls and stretchable or squeezable rings. By engaging in simple repetitive movements, such as spinning and rolling, users can experience calming tactile feedback and enhance concentration during study, work, or play. Fidget toys have become increasingly popular due to their ability to combine entertainment with stress-relief in a compact and portable form.

Conventional fidget toys generally provide only a single type of play function. For example, rolling-type fidget toys, such as spinner rings, are typically made of rigid materials and allow only rotational movement, while stretchable or squeezable rings are made of soft elastic materials and allow only squeezing or stretching. Such single-function designs are often not sufficient to meet the diversified needs of children and teenagers, who require both varied play modes and enhanced sensory engagement to maintain focus and relieve stress.

Moreover, conventional fidget toys are not always suitable for children. Many rolling-type fidget toys are made of rigid materials and include hard or sharp edges that may cause discomfort or injury during use. Others comprise small detachable components that may present a choking hazard. In addition, rigid spinner rings lack soft, skin-friendly surfaces, making them less comfortable for prolonged use by children. Conversely, soft rings provide comfort but lack interactive rolling play.

SUMMARY OF THE PRESENT INVENTION

The invention is advantageous in that it provides a finger spinner ring which comprises an inner rolling ring and an outer flexible ring, wherein the outer flexible ring provides comfortable tactile feedback, while rotation of the outer flexible ring adds a dynamic fidgeting sensation.

Another advantage of the present invention is to provide a finger spinner ring which combines a rotatable inner and outer ring structure with a detachable soft and resilient texture outer ring so as to allow both rolling and squeezing or stretching functions in a single device.

Another advantage of the present invention is to provide a finger spinner ring, wherein the outer flexible ring have a texture surface which can be multiple types of texture patterns, such as ridges, bumps and grooves. These varied textures allow users to experience different tactile sensations while rotating the outer flexible ring or when the outer flexible ring is removed for squeezing and stretching. By offering a range of textures, the invention further enhances sensory engagement, encourages exploration, and provides more versatile fidgeting experiences for children and teenagers.

Another advantage of the present invention is to provide a finger spinner ring, wherein the outer flexible ring is made from soft, skin-friendly materials without sharp edges or small rigid detachable parts, making it safe and suitable for children.

Another advantage of the present invention is to provide a finger spinner ring, wherein the structure of the inner rolling ring is simple and easy to achieve a rolling effect.

Additional advantages and features of the invention will become apparent from the description which follows, and may be realized by means of the instrumentalities and combinations particularly pointing out in the appended claims.

According to the present invention, the foregoing and other objects and advantages are attained by a finger spinner ring, comprising:

an inner rolling ring having a finger passage; and an outer flexible ring which is detachably provided on the inner rolling ring and surrounding the inner rolling ring.

According to an embodiment, the inner rolling ring comprises an inner finger wearing ring having the finger passage and an outer ring element rotatably mounted on the inner finger wearing ring, wherein the outer flexible ring is detachably mounted on the outer ring element for being driven to rotate along with the outer ring element, wherein the outer ring element is located between the inner finger wearing ring and the outer flexible ring.

According to an embodiment, the inner rolling ring comprises an outer surface along a circumferential direction, the outer flexible ring comprises an inner surface which is biasing against the outer surface of the inner rolling ring when the outer flexible ring is detachably mounted on the inner rolling ring.

According to an embodiment, the outer surface of the inner rolling ring defines a concave groove for receiving the inner surface of the outer flexible ring.

According to an embodiment, the outer surface of the inner rolling ring is a curved surface with a diameter gradually decreases toward a middle portion thereof to define the concave groove.

According to an embodiment, an outer diameter of the middle portion of the outer surface of the inner rolling ring is equal to or larger than an inner diameter of the inner surface of the outer flexible ring.

According to an embodiment, the inner rolling ring comprises two protrusion edges integrally protruded from two axial ends of the outer surface of the inner rolling ring to define a concave groove for receiving the inner surface of the outer flexible ring.

According to an embodiment, the inner surface of the outer flexible ring is a circumferential smooth surface.

According to an embodiment, the outer flexible ring comprises an outer ring body comprising an outer surface and a plurality of protrusions integrally extended from the outer surface of the outer ring body.

According to an embodiment, the outer flexible ring comprises an outer ring body comprising an outer surface, a plurality of protrusions integrally extended from the outer surface of the outer ring body, and a plurality of inner protrusions integrally extended from the inner surface of the outer flexible ring.

According to an embodiment, the outer flexible ring is made of a resilient material selected from the group consisting of silicone rubber, thermoplastic elastomer, thermoplastic polyurethane, and thermoplastic rubber, wherein the inner rolling ring is made of plastic.

According to an embodiment, the inner finger wearing ring comprises an outer circumferential surface, wherein the outer ring element is arranged on the inner finger wearing ring to define a circumferential clearance therebetween to allow the outer ring element to be rotatable with respect to the inner finger wearing ring.

According to an embodiment, the outer ring element comprises two ring parts which are rotatably arranged on two axial sides of the inner finger wearing ring, and one or more coupling mechanisms for mounting the two ring parts with each other.

According to an embodiment, the inner finger wearing ring comprises a ring body and a circumferential step which is integrally protruded at an outer side of the ring body at a middle area thereof, wherein two indented grooves are formed at two opposite sides of the circumferential step, wherein the outer circumferential surface of the inner finger wearing ring comprises two first circumferential surface portions formed on the ring body and a second circumferential surface portion formed on the circumferential step, an outer diameter of the second circumferential surface portion on the circumferential step is larger than an outer diameter of each of the two first circumferential surface portions formed on the ring body, each of the two ring parts has an inner channel for disposing and accommodating a portion of the inner finger wearing ring and comprises a ring member having an inner circumferential wall, and a protrusion ring which is integrally protruded from the ring member and extended into the inner channel, wherein the protrusion ring has a step circumferential wall which has an inner diameter smaller than an inner diameter of the inner circumferential wall of the ring member, a circumferential groove is formed between the inner circumferential wall of the ring member and the protrusion ring for accommodating a portion of the circumferential step of the inner finger wearing ring.

According to an embodiment, when the two ring parts are assembled on the inner finger wearing ring, the two protrusion rings of the two ring parts are located at two opposite sides of the circumferential step.

According to an embodiment, each of the two ring parts comprise an inner circumferential end wall, each of the one or more coupling mechanisms comprises a first coupling element and a second coupling elements which are respectively disposed on the inner circumferential end walls of the two ring parts, wherein when the two ring parts are sleeved on the inner finger wearing ring, the first coupling element and the second coupling element are located at an outer side of the inner finger wearing ring.

According to an embodiment, the inner rolling ring comprises an inner finger wearing ring and an outer ring element rotatably coupled to the inner finger wearing ring and surrounding the inner finger wearing ring, wherein a circumferential bearing groove is formed between the inner finger wearing ring and the outer ring element, a plurality of bearing balls are disposed in the circumferential bearing groove between the inner finger wearing ring and the outer ring element to allow rotation of the outer ring element with respect to the inner finger wearing ring.

According to an embodiment, the outer flexible ring comprises a surface texture which comprises one or more of conical protrusions, square protrusions, circular protrusions, axial ribs extending along an axial direction, circumferential ribs extending along a circumferential direction, and thread ribs arranged spirally and circumferentially.

According to an embodiment, the inner finger wearing ring comprises a first inner ring component and a second inner ring component which are sleeved with each other to define a retaining groove for rotatably mounting the outer ring element.

According to an embodiment, the first inner ring component comprises a first inner ring body having the finger passage, and a first circumferential flange integrally extended from the first inner ring body, the second inner ring component comprises a second inner ring body and a second circumferential flange integrally extended from the second inner ring body, wherein the second inner ring body is sleeved on the first inner ring body to define the retaining groove between the first circumferential flange and the second circumferential flange at an outer side of the second inner ring body.

The present invention further provides a finger spinner ring set, comprising:

an inner rolling ring which is made of a rigid material and comprises an inner finger wearing ring having a finger passage and an outer ring element rotatably mounted on the inner finger wearing ring;

a first outer flexible ring which is capable of being detachably provided on the inner rolling ring for being driven to rotate along with the outer ring element, wherein the first outer flexible ring comprises a first outer ring body and a plurality of first protrusions protruded on the first outer ring body to form a first texture pattern; and a second outer flexible ring which is capable of being detachably provided on the inner rolling ring for being driven to rotate along with the outer ring element, wherein the second outer flexible ring comprises a second outer ring body and a plurality of second protrusions protruded on the second outer ring body to form a second texture pattern which is different from the first texture pattern.

The present invention further provides a finger spinner ring set, comprising:

a first inner rolling ring which is rigid and comprises a first inner finger wearing ring having a first finger passage and a first outer ring element rotatably mounted on the first inner finger wearing ring;

a first outer flexible ring which is capable of being detachably provided on the first inner rolling ring for being driven to rotate along with the first outer ring element, wherein the first outer flexible ring comprises a first outer ring body and a plurality of first protrusions protruded on the first outer ring body to form a first texture pattern;

a second inner rolling ring which is rigid and comprises a second inner finger wearing ring having a second finger passage and a second outer ring element rotatably mounted on the second inner finger wearing ring; and a second outer flexible ring which is capable of being detachably provided on the second inner rolling ring for being driven to rotate along with the second outer ring element, wherein the second outer flexible comprises a second outer ring body and a plurality of second protrusions protruded on the second outer ring body to form a second texture pattern which is different from the first texture pattern Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
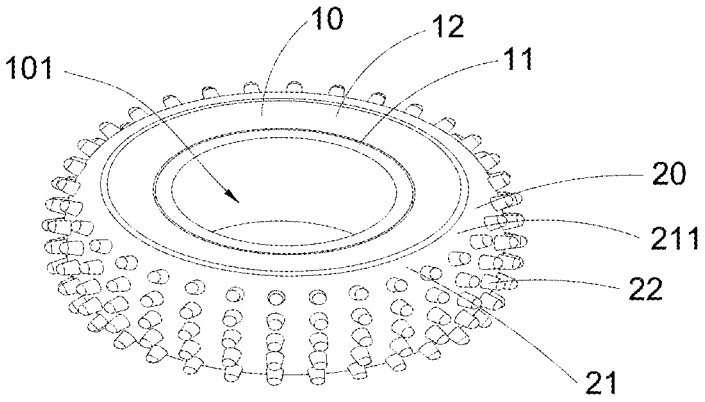
FIG. 1A is a perspective view of a finger spinner ring according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1A to FIG. 31 of the drawings, a finger spinner ring according to a preferred embodiment of the present invention is illustrated, the finger spinner ring comprises an inner rolling ring 10 and an outer flexible ring 20 which is detachably provided around the inner rolling ring 10. The inner rolling ring 10 has an finger passage 101 to allow a finger of a user to pass therethrough, so as to allow the finger spinner ring to be worn on a wearing finger of the user while another finger of the user come into contact with the outer flexible ring 20.

In this arrangement, the inner rolling ring 10 is made of a rigid material, such as plastic and metal, preferred plastic, the outer flexible ring 20 is made of a soft and flexible material. The wearing finger stabilizes the device through the finger passage 101, while another finger of the user may press, slide, or rotate against the outer flexible ring 20. This structural relationship enables the user to simultaneously experience the rolling sensation generated by the inner rolling ring 10 and the tactile comfort provided by the outer flexible ring 20. The soft material of the outer flexible ring 20 further enhances safety and comfort, making the device particularly suitable for children and teenagers.

When the outer flexible ring 20 is detached from the inner rolling ring 10, the outer flexible ring 20 serves as a standalone stretchable and squeezable ring, enabling the user to perform pulling, pressing, or twisting motions for tactile stress relief, so that the finger spinner ring of the present invention enables both rolling play when attached and squeezing or stretching play when detached.

The outer flexible ring 20 comprises an outer ring body 21 and a plurality of protrusions 22 formed on an outer surface 211 of the outer ring body 21 to form a texture pattern 23. Preferably, the plurality of protrusions 22 are evenly distributed on the outer surface of the outer ring body 21.

Figure 1B:
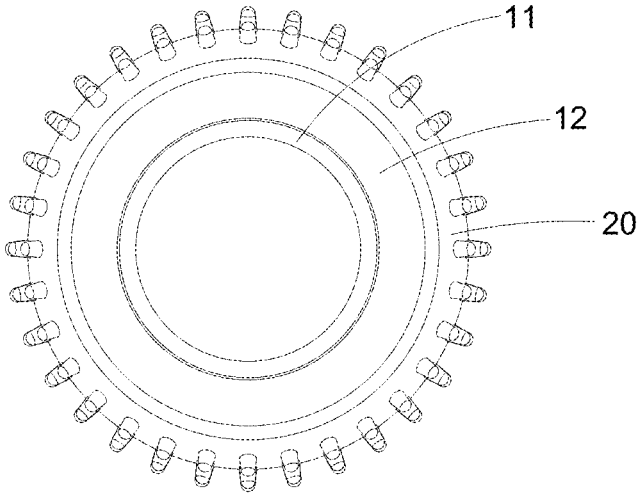
FIG. 1B is a top view of the finger spinner ring according to the above preferred embodiment of the present invention.
Figure 1C:
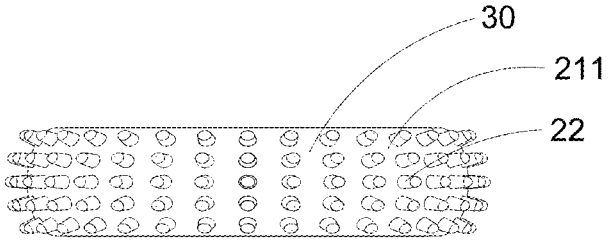
FIG. 1C is a side view of the finger spinner ring according to the above preferred embodiment of the present invention.
Figure 2:
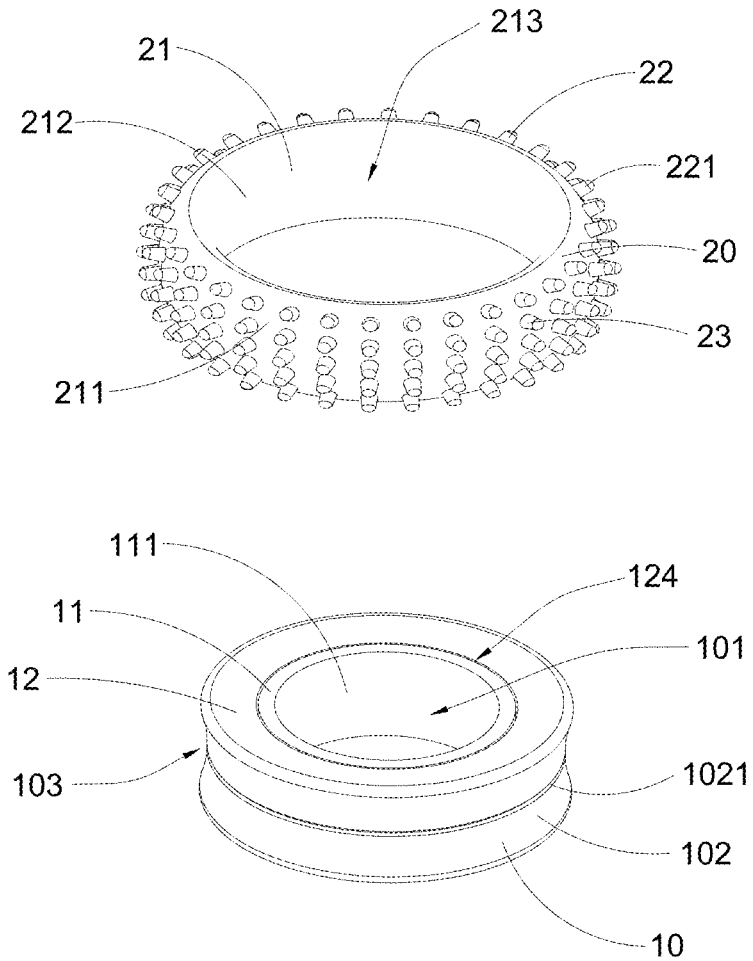
FIG. 2 is an exploded view of the finger spinner ring according to the above preferred embodiment of the present invention.
Figure 5:
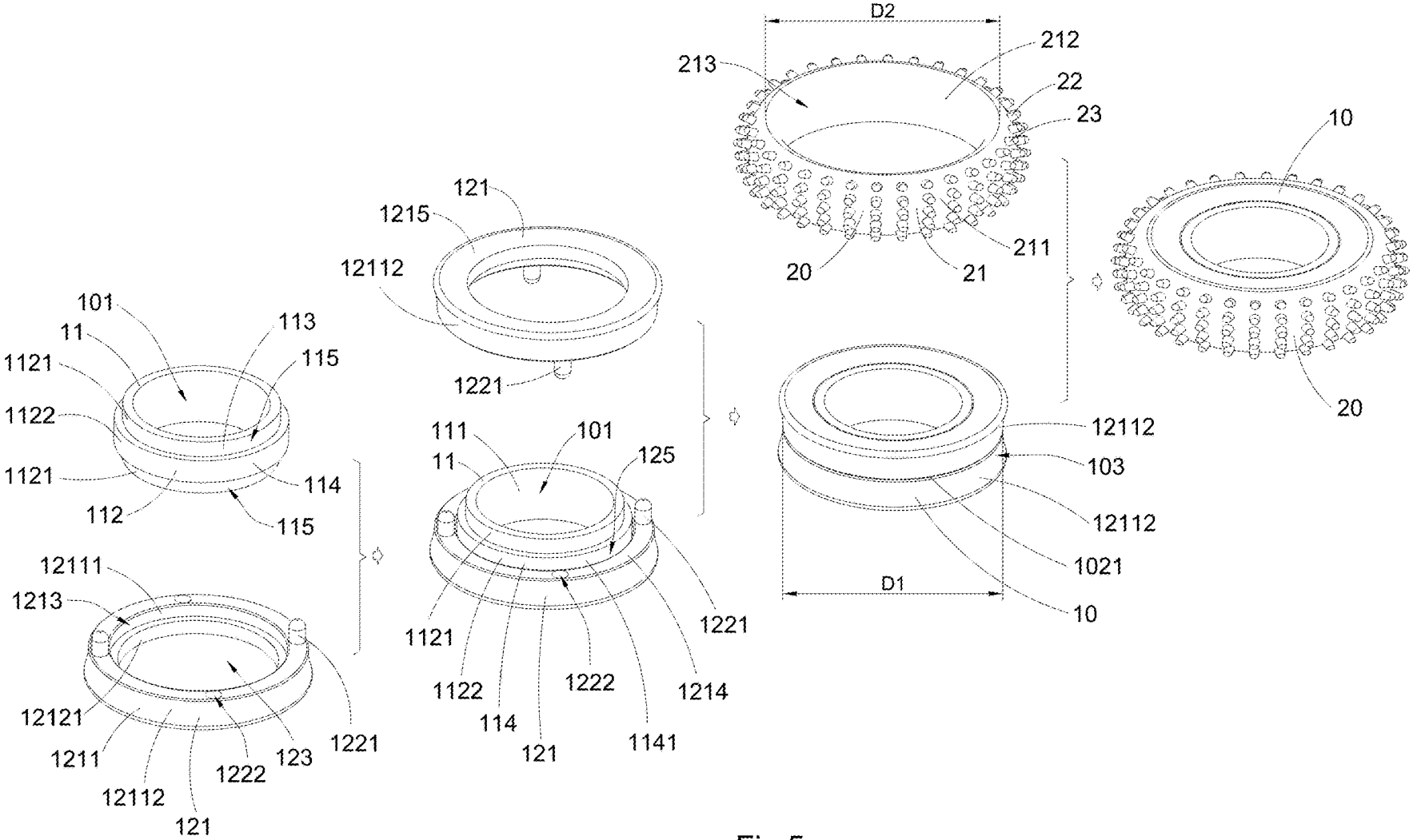
FIG. 5 is schematic view illustrating the assembling process of the finger spinner ring according to the above preferred embodiment of the present invention.
Figure 6:
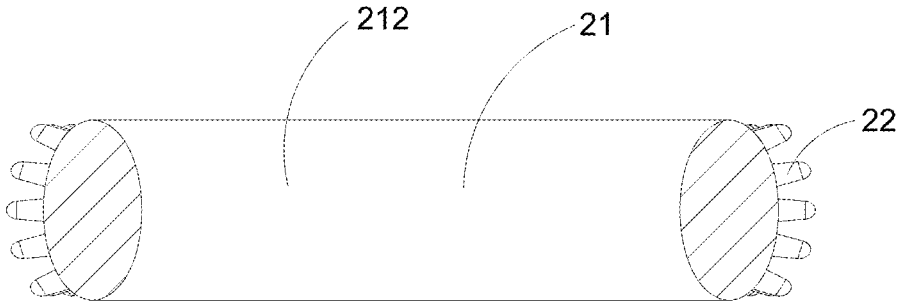
FIG. 6 is a sectional view of an outer flexible ring of the finger spinner ring according to the above preferred embodiment of the present invention.
Figure 9:
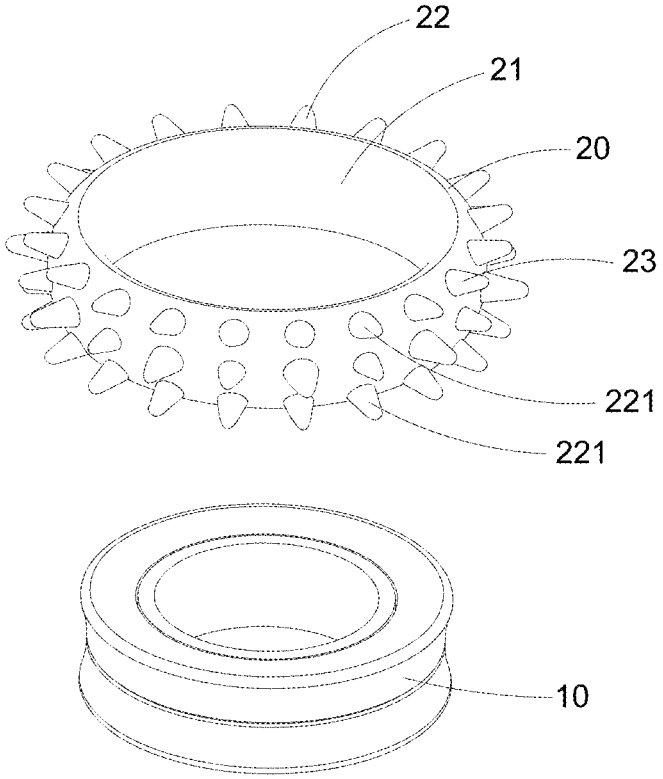
FIG. 9 is an exploded view of the finger spinner ring according to the above preferred embodiment of the present invention, wherein a first alternative outer flexible ring is illustrated.

As shown in FIGS. 1-2 and 5 of the drawings, each of the plurality of protrusions 22 protruded from the outer ring body 21 can be embodied as a conical protrusion 221. As shown in FIG. 9 of the drawings, the plurality of protrusions 22 may have different heights.

Figure 10:
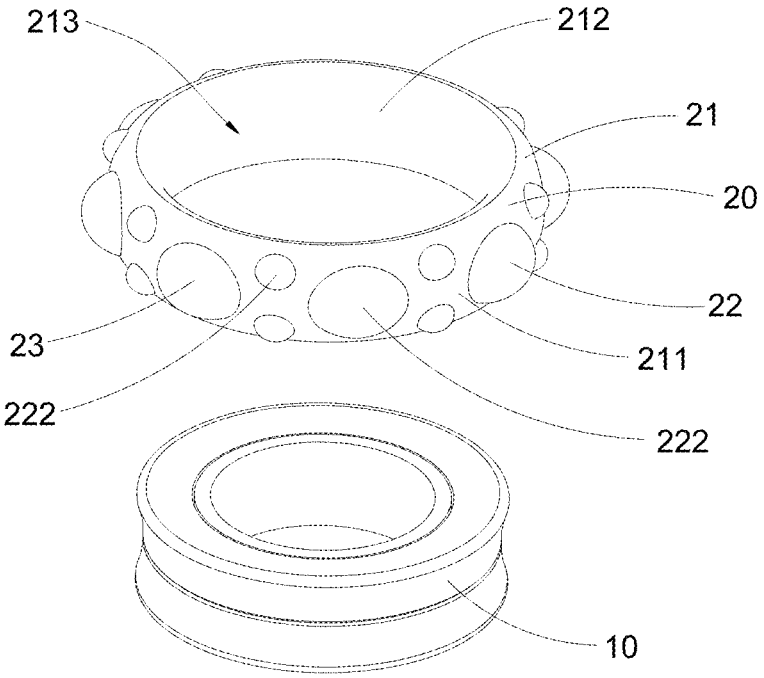
FIG. 10 is an exploded view of the finger spinner ring according to the above preferred embodiment of the present invention, wherein a second alternative outer flexible ring is illustrated.

As shown in FIG. 10 of the drawings, each of the plurality of protrusions 22 protruded from the outer ring body 21 can be embodied as a circular protrusion 222 in the form of a hemispherical bump, and the plurality of protrusions 22 can have different diameters and heights. As shown in the drawings, the protrusions 22 with larger sizes and the protrusions 22 with smaller sizes can be alternating on the outer ring ring body 21. This alternating configuration enhances sensory stimulation by providing diverse pressure points when contacted by the user's finger, thereby enriching the tactile experience. Furthermore, the variation in protrusion sizes prevents monotony in touch sensation and increases user engagement, while also contributing to the distinctive visual appeal of the finger spinner ring.

Figure 11:
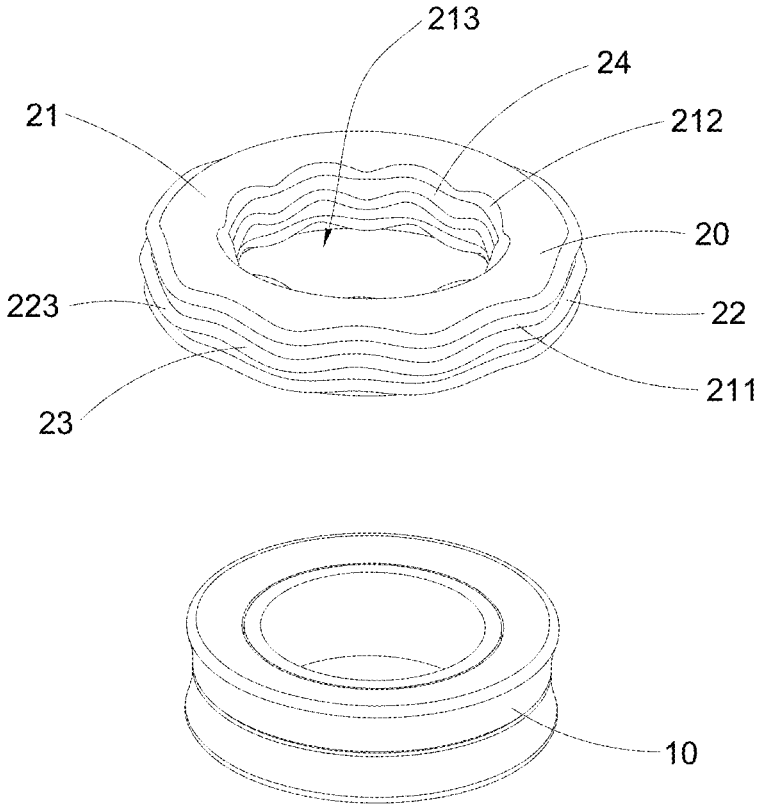
FIG. 11 is an exploded view of the finger spinner ring according to the above preferred embodiment of the present invention, wherein a third alternative outer flexible ring is illustrated.

As shown in FIG. 11 of the drawings, each of the plurality of protrusions 22 protruded from the outer ring body 21 can be embodied as a circumferential ribs 223 extending along the circumferential direction and can be wavy along the circumference. The adjacent protrusion ribs can be spaced apart from each other. The wavy configuration further enhances the sensory stimulation by introducing alternating pressure points, increasing play value, and offering a more engaging tactile feedback experience.

Figure 13:
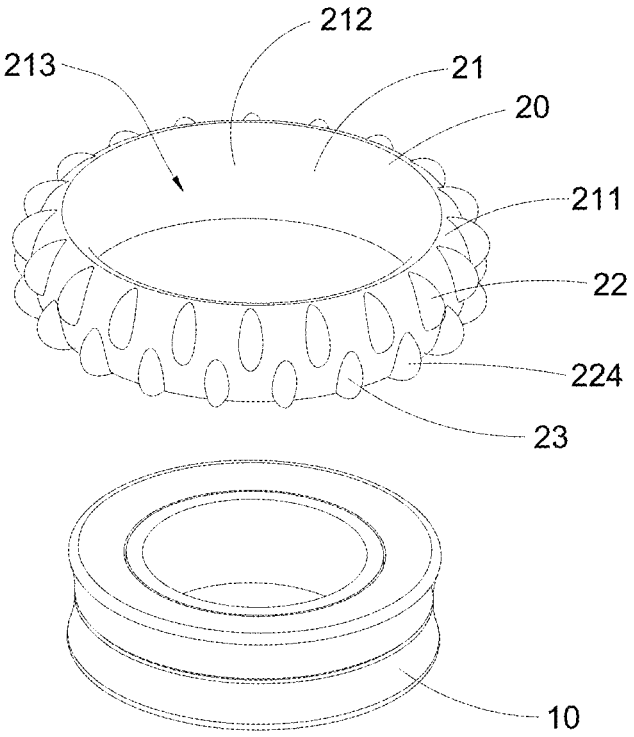
FIG. 13 is an exploded view of the finger spinner ring according to the above preferred embodiment of the present invention, wherein a fourth alternative outer flexible ring is illustrated.

As shown in FIG. 13 of the drawings, each of the plurality of protrusions 22 protruded from the outer ring body 21 can be embodied as an axial rib 224 extending along the axial direction. The adjacent protrusion ribs can be spaced apart from each other. One or more rows of the axial ribs 224 can be provided on the outer surface 211 of the outer ring body 21. The arrangement of one or more rows of axial ribs allows variation in tactile intensity and provides multiple levels of engagement for the user, further increasing the playability and sensory richness of the finger spinner ring.

Figure 14:
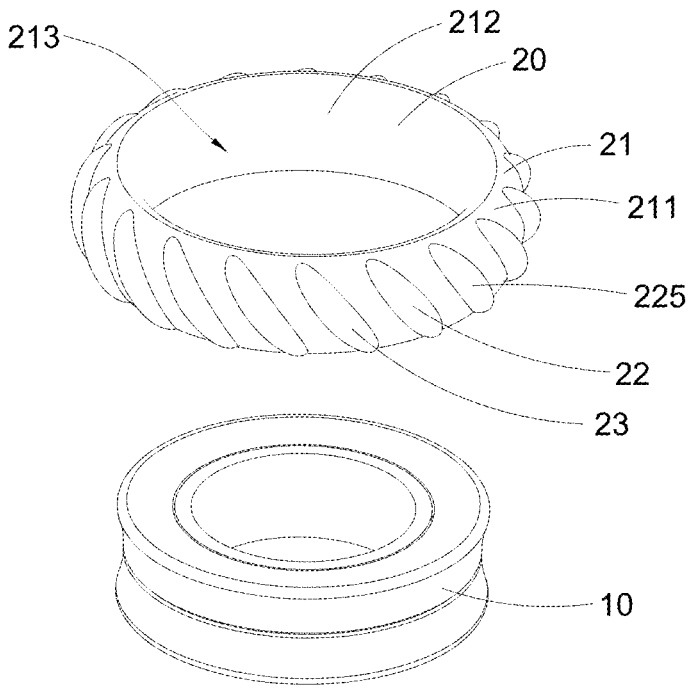
FIG. 14 is an exploded view of the finger spinner ring according to the above preferred embodiment of the present invention, wherein a fifth alternative outer flexible ring is illustrated.

As shown in FIG. 14 of the drawings, the plurality of protrusions 22 protruded from the outer ring body 21 are thread-like ribs 225 arranged spirally and circumferentially on the outer surface 211 of the of the outer ring body 21. The spiral configuration of the ribs provides a distinctive tactile sensation when the user's finger moves across the surface, generating both linear and rotational feedback. This arrangement not only enhances the sensory stimulation and play value of the finger spinner ring, but also improves the aesthetic appeal by simulating the appearance of a threaded or helical pattern.

Accordingly, the outer flexible ring 20 may be provided with multiple types of surface textures to enhance tactile stimulation and user engagement. The surface textures may include, for example, conical protrusions, square protrusions, circular protrusions, axial ribs extending along the axial direction, circumferential ribs extending along the circumferential direction, or thread-like ribs arranged spirally and circumferentially. These textured patterns can be integrally formed on the surface of the outer flexible ring 20 during molding, or added through secondary processing.

By providing a variety of surface textures, the outer flexible ring 20 allows the user to experience different tactile sensations during play. The conical, square, or circular protrusions create distinct point-contact stimulation, while the axial ribs provide a longitudinal sliding feel when fingers move along the axis. The circumferential ribs and thread-like ribs provide a spiral or rolling tactile sensation when the ring rotates. Such variety of tactile surfaces significantly enhances sensory richness and play value, encouraging children and teenagers to explore different modes of interaction with the toy.

The outer flexible ring 20 provides enhanced sensory stimulation through different protrusion shapes, protrusion heights and rib patterns, generating diverse tactile feedback for the user. The variety of textures allows children to select or interchange the outer flexible rings 20 according to their preferences, providing a customizable user experience. Multiple tactile options help maintain engagement, prevent boredom, and encourage repeated use. In addition, the varied textures may offer therapeutic benefits by promoting calming or focusing effects, which can aid in stress relief or concentration. The textured patterns also contribute to a distinctive aesthetic appeal, making the toy more visually attractive and enjoyable for children.

Figure 18:
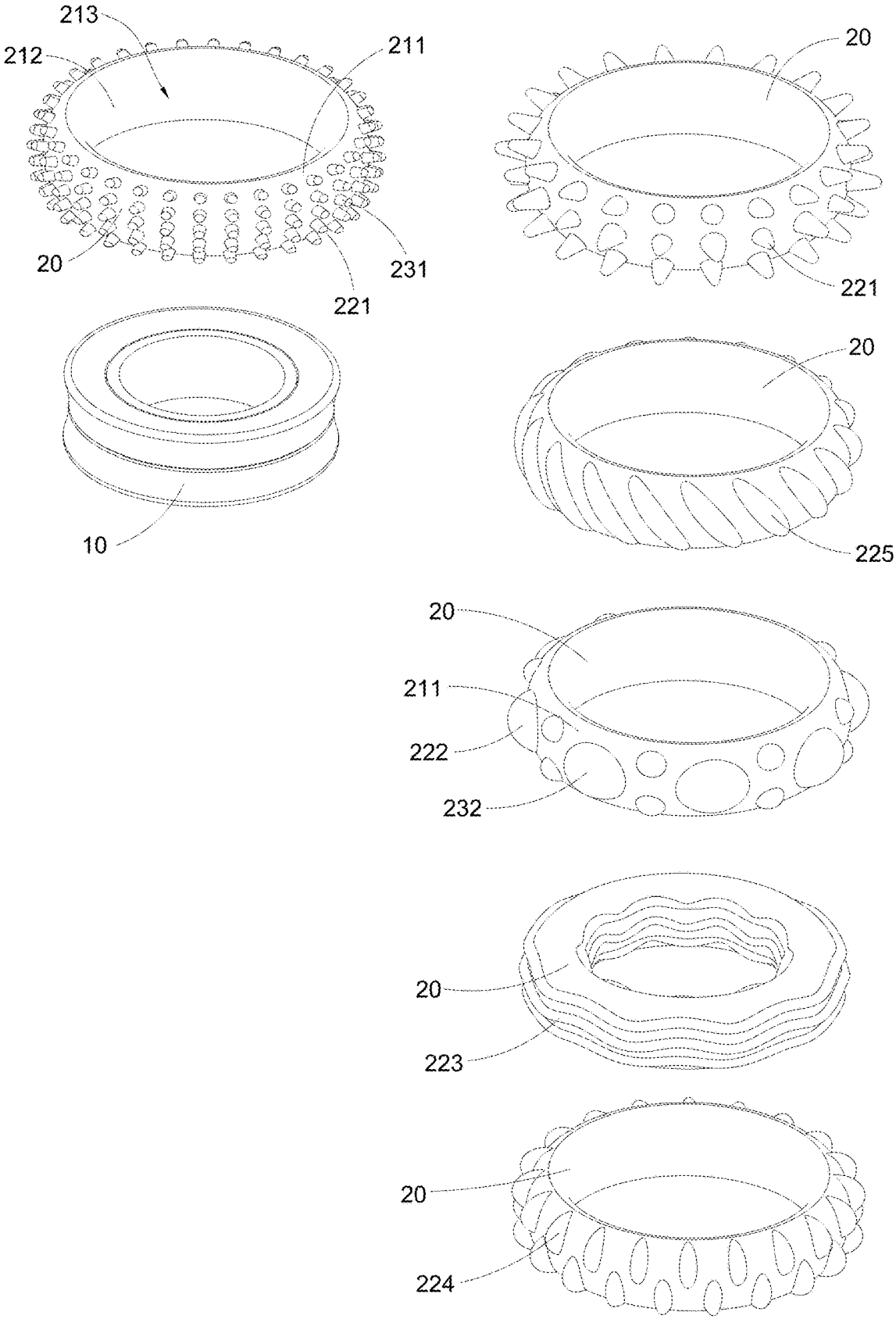
FIG. 18 is a schematic view illustrating a plurality of outer flexible rings being capable of being assembled on the inner rolling ring of the finger spinner ring according to the above preferred embodiment of the present invention.

Accordingly, as shown in FIG. 18, a plurality of the outer flexible ring 20 can be detachably coupled to the inner rolling ring 10 to provide a finger spinner ring set to allow the user to select or interchange the outer flexible rings 20. As shown in FIGS. 1-2, 5, 9 and 18 of the drawings, the plurality of protrusions 22 which are embodied as conical protrusions 221 form a first texture pattern 231. As shown in FIG. 10 and FIG. 18 of the drawings, the plurality of protrusions 22 which are embodied as circular protrusions 222 form a second texture pattern 232 which is different from the first texture pattern 231.

Figure 19:
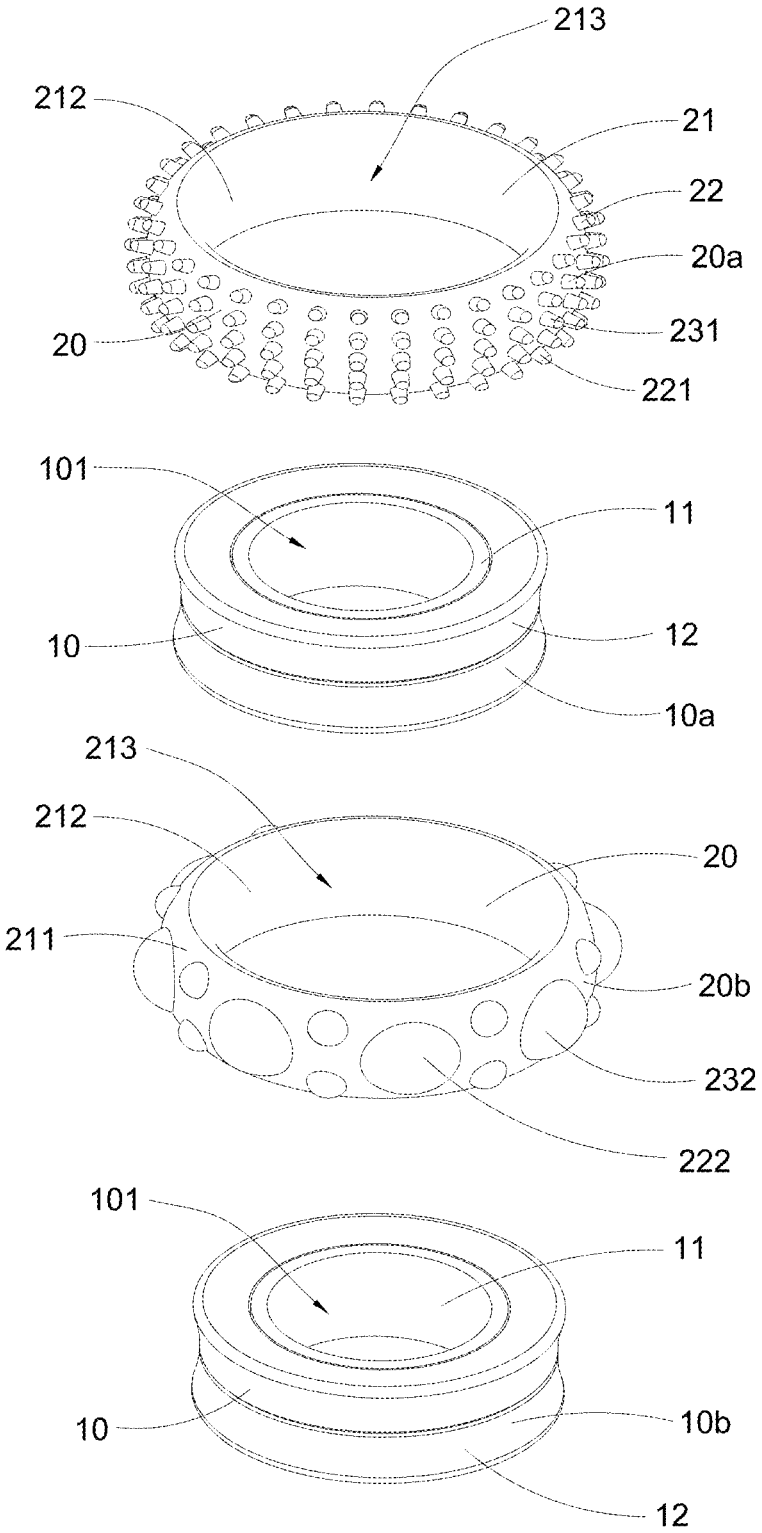
FIG. 19 is a schematic view illustrating a finger spinner ring set including two more finger spinner rings according to the above preferred embodiment of the present invention.

As shown in FIG. 19 of the drawings, the finger spinner ring set can be embodied to comprise a plurality of inner rolling rings 10 and a plurality of outer flexible rings 20. As an example, the finger spinner ring set can be embodied to comprise a first finger spinner ring which comprises a first inner rolling 10*a* and a first outer flexible ring 20*a*, a second finger spinner ring which comprises a second inner rolling 10*b* and a second outer flexible ring 20*b*, the plurality of protrusions 22 of the first outer flexible ring 20*a* are embodied as conical protrusions 221 forming a first texture pattern 231, the plurality of protrusions 22 of the second flexible ring 20*b* are embodied as circular protrusions 222 forming a second texture pattern 232 which is different from the first texture pattern 231.

Such a configuration allows different finger spinner rings in the set to provide distinct tactile feedback and sensory experiences to the user. The availability of multiple texture patterns further enables children or users to select or interchange rings based on personal preference, thereby enhancing play value, sensory engagement, and therapeutic benefit.

As shown in FIGS. 3-5 and 7-8 of the drawings, the finger spinner ring set can be embodied to comprise an inner rolling ring 10 and two outer flexible rings 20 which can be detachably surrounding around two portions of the inner rolling ring, and the two outer flexible rings 20 can be embodied to have different texture patterns 23.

Preferably, the outer flexible ring 20 is made of resilient material, such as silicone rubber, thermoplastic elastomer (TPE), thermoplastic polyurethane (TPU), thermoplastic rubber (TPR). These materials provide a soft and elastic surface that ensures comfortable contact with the user's finger, while also maintaining sufficient durability to withstand repeated rolling, squeezing, and stretching. In addition, the resilient nature of the material enables the formation of various surface textures, such as protrusions, ribs, or grooves, thereby enhancing the tactile feedback and sensory stimulation experienced by the user. Furthermore, the use of non-toxic and hypoallergenic materials ensures safety for children and long-term usability.

Preferably, the inner rolling ring 10 is made of a rigid plastic material which provides sufficient structural strength and wear resistance to support the outer flexible ring 20 and allow smooth relative rotation therebetween. Suitable examples of the plastic material include acrylonitrile butadiene styrene (ABS) for its excellent impact resistance and smooth finish, polycarbonate (PC) for its high strength and dimensional stability, nylon (PA) for its low friction and durability, polyoxymethylene (POM) for its self-lubricating property and superior wear resistance, polypropylene (PP) for its lightweight and chemical resistance, and polyethylene (PE) for its toughness and low friction coefficient. By employing these materials, the inner rolling ring 10 can maintain a lightweight structure while ensuring smooth rotation, long-term durability, and safety for children's use.

The inner rolling ring 10 comprises an outer surface 102, the outer ring body 21 of the outer flexible ring 20 comprises an inner surface 212 defining an inner passage 213 which is a penetrating hole, the inner rolling ring 10 is disposed in the inner passage 213 of the outer ring body 21 of the outer flexible ring 20, and the inner surface 212 of the outer ring body 21 is biasing against the outer surface 102 of the inner rolling ring 10, so as to retain the outer flexible ring 20 on the inner rolling ring 10.

As an example, the inner surface 212 of the outer ring body 21 and the outer surface 102 of the inner rolling ring 10 can be smooth circumferential surfaces, the inner surface 212 of the outer ring body 21 can be shaped and sized to couple with the outer surface 102 of the inner rolling ring 10 to allow the inner surface 212 of the outer ring body 21 to have frictional contact with the outer surface 102 of the inner rolling ring 10, so as to retain the outer flexible ring 20 on the inner rolling ring 10.

In addition to the frictional engagement between the inner surface 212 of the outer ring body 21 and the outer surface 102 of the inner rolling ring 10, alternative retaining structures may also be employed to detachably mount the outer flexible ring 20 on the inner rolling ring 10. For example, the inner surface 212 of the outer ring body 21 and the outer surface 102 of the inner rolling ring 10 may be correspondingly provided with snap-fit structures or latching projections so as to form a mechanical engagement. In another example, one or more annular grooves may be formed on the outer surface 102 of the inner rolling ring 10, while corresponding ribs or ridges are formed on the inner surface 212 of the outer ring body 21, thereby providing a groove-rib coupling engagement. In yet another embodiment, magnetic elements may be embedded in the inner rolling ring 10 and the outer flexible ring 20 such that the magnetic attraction forces retain the two components together. These alternative retaining arrangements provide design flexibility, facilitate convenient installation and removal of the outer flexible ring 20, and broaden the applicability of the finger spinner ring.

Figure 12:
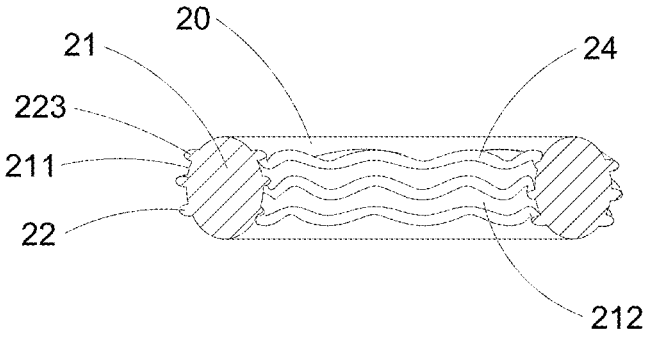
FIG. 12 is a sectional view illustrating the third alternative outer flexible ring of the finger spinner ring according to the above preferred embodiment of the present invention.
Figure 15:
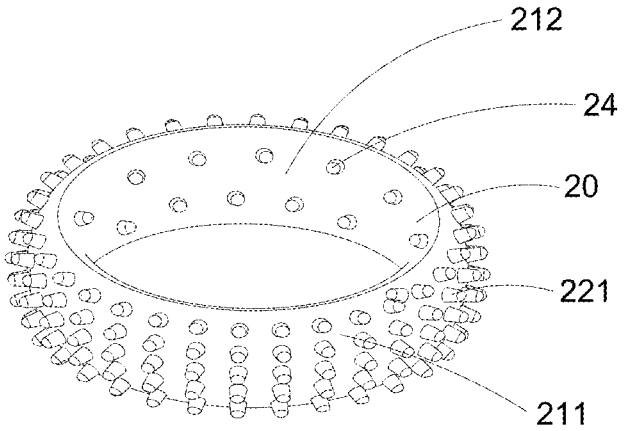
FIG. 15 is a perspective view illustrating a sixth alternative outer flexible ring of the finger spinner ring according to the above preferred embodiment of the present invention.
Figure 16:
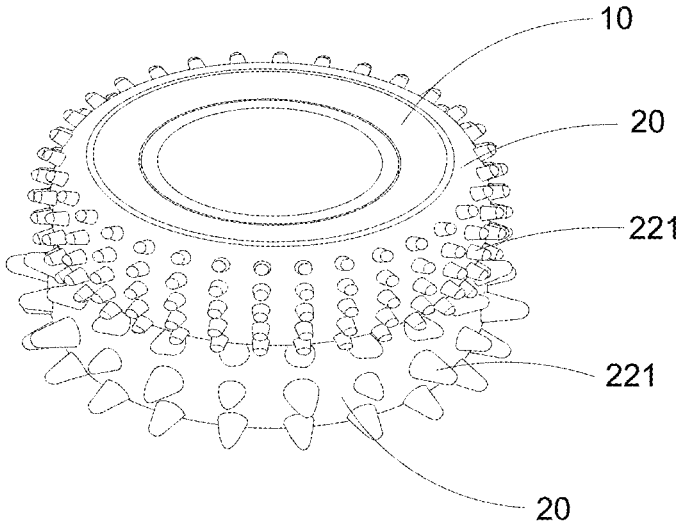
FIG. 16 is a perspective view illustrating two outer flexible rings being assembled on the inner rolling ring of the finger spinner ring according to the above preferred embodiment of the present invention.
Figure 17:
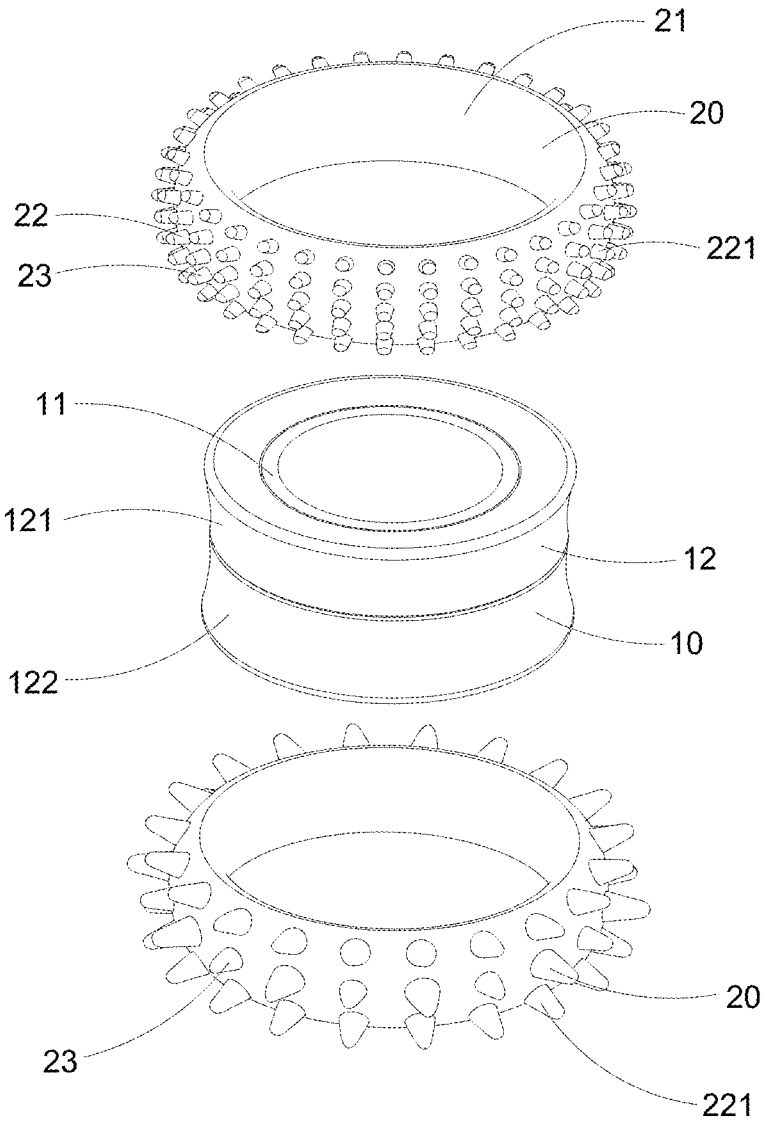
FIG. 17 is an exploded view illustrating two outer flexible rings being assembled on the inner rolling ring of the finger spinner ring according to the above preferred embodiment of the present invention.

As shown in FIGS. 12 and 15 of the drawings, the outer flexible ring 20 further comprises a plurality of inner protrusions 24 which is integrally protruded from the inner surface 212 of the outer ring body 21 for biasing against the outer surface 102 of the inner rolling ring 10. The inner rolling ring 10 has a concave groove 103 recessed on the outer surface 102 of the inner rolling ring 10, the plurality of inner protrusions 24 are extended into the concave groove 103 are retained in the concave groove 103. Through this engagement, the outer flexible ring 20 is securely mounted on the inner rolling ring 10 while still being detachable when a removal force is applied. Such a groove-and-protrusion coupling not only enhances the stability of the connection and prevents accidental dislodgement of the outer flexible ring 20 during use, but also facilitates easy replacement of different textured outer rings to provide varied tactile experiences.

Figure 7:
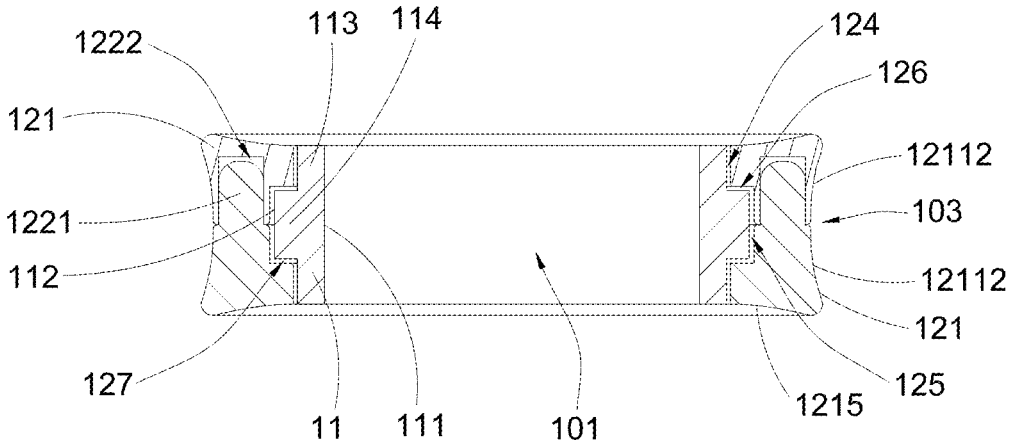
FIG. 7 is a sectional view of the inner rolling ring of the finger spinner ring according to the above preferred embodiment of the present invention.
Figure 8:
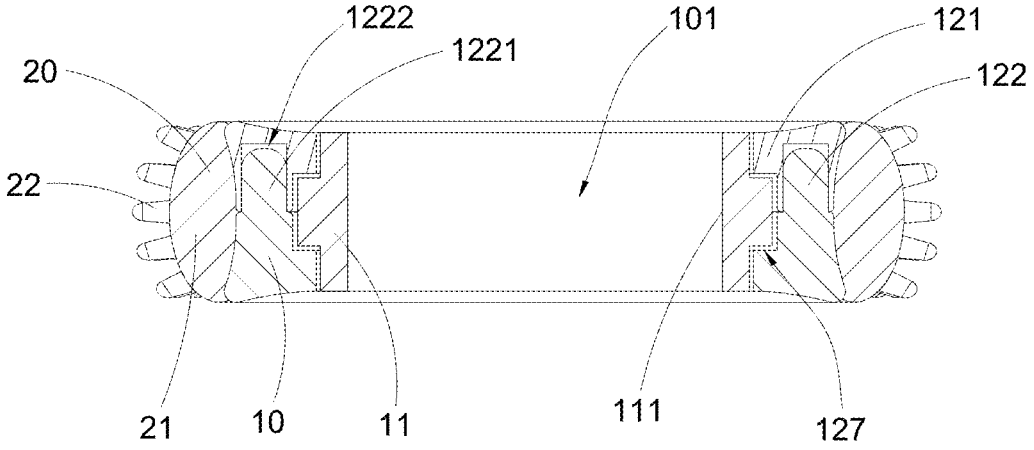
FIG. 8 is a sectional view of the finger spinner ring according to the above preferred embodiment of the present invention.

As shown in FIGS. 5 and 7-8, the outer surface 102 of the inner rolling ring 10 is configured such that the diameter gradually decreases from two opposite end portions toward a middle portion, thereby forming an arcuate concave surface along the axial direction of the inner rolling ring 10. This concave contour facilitates stable positioning of the outer flexible ring 20 by guiding the inner surface 212 thereof into a central seating position. In addition, the arcuate concave configuration enhances the engagement between the inner rolling ring 10 and the outer flexible ring 20, reduces the likelihood of lateral displacement during rolling, and provides an ergonomic curvature that improves the overall handling comfort of the finger spinner ring.

The outer surface 102 of the inner rolling ring 10 is further configured such that the two ends thereof have a maximum diameter relative to the middle portion 1021 thereof. In this manner, the arcuate concave contour not only guides the outer flexible ring 20 into a central seating position, but also prevents the inner protrusions 24 of the outer flexible ring 20 from slipping away from the concave groove 103. The increased diameter at the two ends functions as retaining shoulders which effectively confine the inner protrusions 24 within the concave groove 103, thereby ensuring secure engagement between the inner rolling ring 10 and the outer flexible ring 20 during use. This arrangement enhances structural reliability, minimizes accidental detachment, and maintains stable rolling performance.

Figure 21:
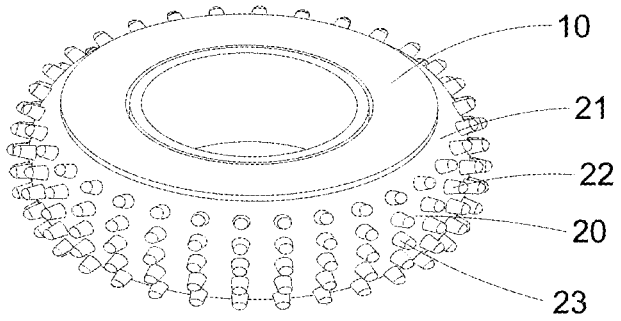
FIG. 21 is a perspective view of a finger spinner ring according to an alternative mode of the above preferred embodiment of the present invention.
Figure 22:
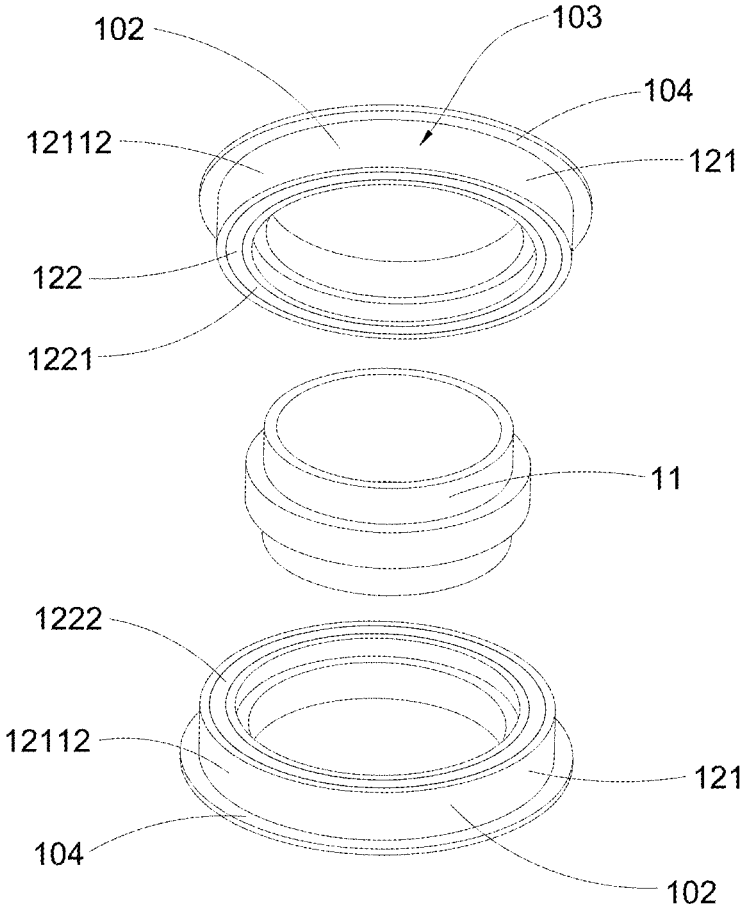
FIG. 22 is an exploded view of an inner rolling ring of the finger spinner ring according to the above alternative mode of the above preferred embodiment of the present invention.
Figure 23:
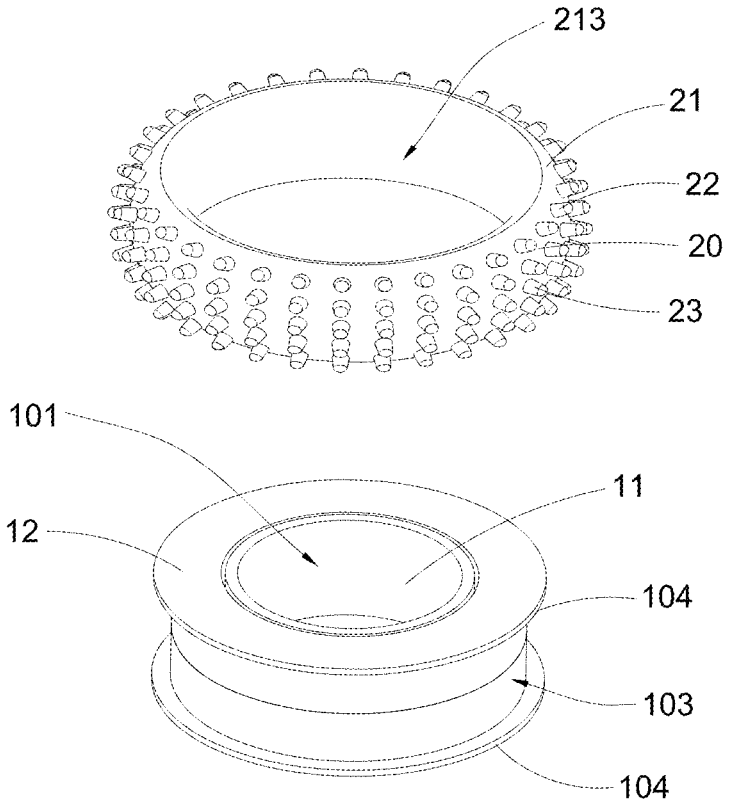
FIG. 23 is an exploded view of the finger spinner ring according to the above alternative mode of the above preferred embodiment of the present invention.

As shown in FIGS. 21 to 23 of the drawings, as an alternative mode, the inner rolling ring 10 further comprises two protrusion edges 104 integrally protruded from two ends of the outer surface 102 of the inner rolling ring 10, so that the concave groove 103 is defined between the outer surface 102 of the inner rolling ring 10 and the two protrusion edges 104 protruded from the outer surface 102 of the inner rolling ring 10. The two circumferential edges 104 function as retaining shoulders, confining the inner protrusions 24 of the outer flexible ring 20 within the concave groove 103 and preventing them from slipping off during use. This configuration ensures stable mounting of the outer flexible ring 20 while maintaining the ability to manually detach and replace the ring when desired.

As shown in FIG. 5, the outer surface 102 of the inner rolling ring 10 is formed such that the middle portion 1021 thereof has a minimum outer diameter D1. In one embodiment, the minimum outer diameter D1 of the middle portion 1021 of the outer surface 102 is substantially equal to the inner diameter D2 of the inner surface 212 of the outer ring body 21, so that the outer flexible ring 20 can be smoothly mounted onto the inner rolling ring 10 while maintaining a stable engagement. In this embodiment shown in the drawings, the minimum outer diameter D1 of the middle portion of the outer surface 102 is slightly larger than the inner diameter D2 of the inner surface 212 of the outer ring body 21, so that a biased elastic interference fit is achieved between the two components. This interference fit further enhances the retention force of the outer flexible ring 20 on the inner rolling ring 10, thereby preventing accidental detachment while still allowing the outer flexible ring 20 to be manually removed and replaced when desired.

The outer flexible ring 20 may be manufactured using conventional molding or extrusion techniques suitable for resilient materials such as silicone, TPE, TPU, or TPR. Preferably, the outer flexible ring 20 is formed by injection molding, which allows precise control over the outer surface textures, including protrusions, ribs, grooves, or thread-like patterns. Alternatively, compression molding or transfer molding can be employed for silicone or thermoset elastomers to achieve the desired shape and texture. For thermoplastic materials, extrusion followed by secondary shaping may also be used. These manufacturing methods enable accurate reproduction of intricate surface features, maintain dimensional stability, and ensure uniform elasticity and tactile quality across the outer flexible ring 20.

In order to form the plurality of surface textures on the outer flexible ring 20, including conical protrusions, circular protrusions, axial ribs, circumferential ribs, and spiral ribs, the outer flexible ring 20 may be produced using precision molds designed with corresponding negative patterns. During injection molding, compression molding, or transfer molding, the resilient material fills the mold cavities, thereby forming the desired protrusions and rib patterns on the outer surface 211 of the outer ring body 21. Conical and circular protrusions can be formed by individual cavity shapes, whereas axial and circumferential ribs can be created by continuous grooves along the mold surface. Spiral or thread-like ribs may be formed by rotating the mold or incorporating spiral grooves in the mold surface. By controlling the mold geometry and injection parameters, the heights, diameters, spacing, and orientations of the protrusions and ribs can be precisely defined, allowing for a wide variety of tactile patterns and ensuring uniformity, repeatability, and high-quality surface finish of the outer flexible ring 20.

As shown in FIGS. 2-5 and 7-8 of the drawings, the inner rolling ring 10 comprises an inner finger wearing ring 11 and an outer ring element 12 which is rotatable with respect to the inner finger wearing ring 11. The inner finger wearing ring 11 comprises an inner circumferential surface 111 defining the finger passage 101, so as to allow the wearing finger of the user to be inserted through the finger passage 101 for wearing the finger spinner ring in a stable manner.

The outer ring element 12 is arranged concentrically around the inner finger wearing ring 11 and provides a rotatable interface for interactive motion. The outer flexible ring 20 can be retained on the outer ring element 12 while being able to move in unison with the rotation of the outer ring element 12. When another finger of the user applies a rolling force on the outer flexible ring 20, the rolling motion is smoothly transmitted to the outer ring element 12, thereby enabling the user to experience continuous spinning and tactile interaction.

The outer flexible ring 20 is configured to be stationary with respect to the outer ring element 12, such that the outer flexible ring 20 does not slip or rotate independently once mounted on the outer ring element 12. Meanwhile, the outer ring element 12 itself is rotatable with respect to the inner finger wearing ring 11, so that when a user applies a rolling force on the outer flexible ring 20, the entire outer ring element 12 rotates with respect to the inner finger wearing ring 11, thereby providing a smooth spinning effect while maintaining the tactile feedback of the textured outer flexible ring 20.

The structure for enabling the rotating movement of the outer ring element 12 with respect to the inner finger wearing ring 11 can be various. As shown in FIG. Of the drawings, in this embodiment, the inner finger wearing ring 11 and the outer ring element 12 can be coupled by a sleeve-fit structure.

More specifically, the inner finger wearing ring 11 comprises an outer circumferential surface 112, the outer ring element 12 is circumferentially provided on the outer circumferential surface 112 of the inner finger wearing ring 11. In this embodiment, the outer ring element 12 comprises two ring parts 121 which are respectively disposed on the outer circumferential surface 112 of the inner finger wearing ring 11. The two ring parts 121 are arranged at opposite axial sides of the inner finger wearing ring 11 to allow the outer ring element 12 to rotate smoothly with respect to the inner finger wearing ring 11 while being axially retained thereon.

Preferably, the two ring parts 121 may be integrally connected with each other through a coupling structure, such as snap-fit connectors, threaded engagement, magnetically attracting engagement or adhesive bonding, so as to form a closed annular structure surrounding the outer circumferential surface 112 of the inner finger wearing ring 11. Alternatively, the two ring parts 121 may be separately mounted and axially confined by retaining flanges formed on the inner finger wearing ring 11, thereby ensuring that the outer ring element 12 does not disengage while maintaining rotational freedom.

As shown in FIGS. 2-5 and 7-8 of the drawings, the outer ring element 12 comprises one or more coupling mechanisms 122 for mounting the two ring parts 121 with each other. Each coupling mechanism 122 comprises a first coupling element 1221 provided on one ring part 121, and a second coupling element 1222 provided on the other ring part 121. The first coupling elements 1221 and the second coupling elements 1222 of this embodiment can be embodied as protrusion pins and retaining grooves which are engaged with each other, so as to form a detachable snap-fit connection.

Preferably, a plurality of the coupling mechanisms 122 may be circumferentially distributed along the edges of the ring parts 121, thereby enhancing the stability of the engagement between the two ring parts 121 and preventing undesired loosening during rotation. The coupling engagement may be designed with an interference fit to provide sufficient frictional force to maintain axial retention, while still allowing manual detachment when replacement or maintenance is required.

Alternatively, the coupling mechanisms 122 may also be embodied as threaded engagement, magnetic attraction, or tongue-and-groove interlocking structures, thereby providing diversified assembly methods according to different design requirements. In all of these cases, the coupling mechanisms 122 ensure that the two ring parts 121 are reliably combined into an annular structure to rotatably surround the outer circumferential surface 112 of the inner finger wearing ring 11.

As shown in FIG. 22 of the drawings, as an alternative mode, the first coupling element 1221 and the second coupling element 1222 can be magnetically attracting with each other to assemble the two ring parts 121.

Figure 20:
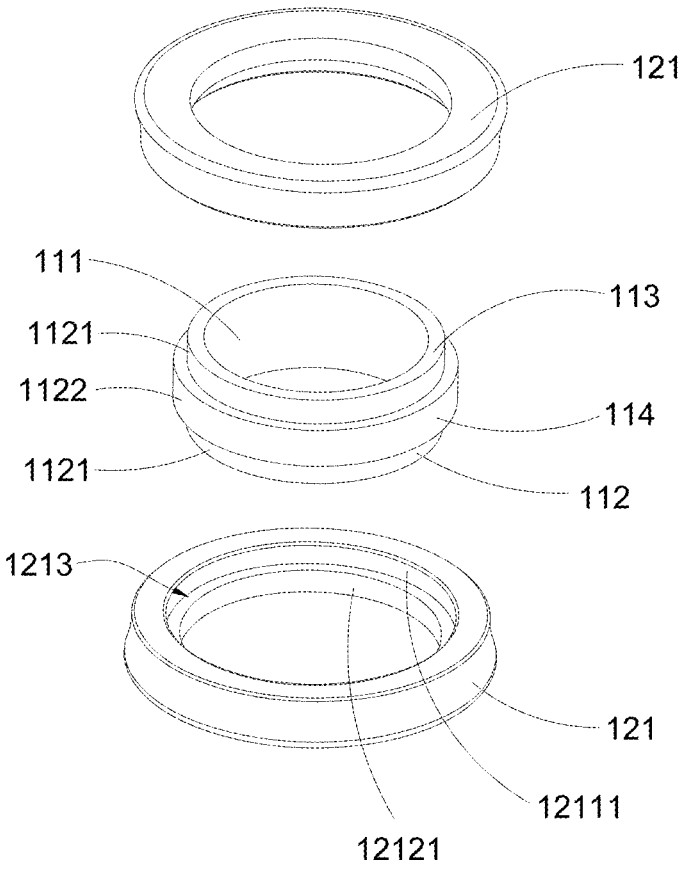
FIG. 20 is an exploded view illustrating an alternative coupling manner between two ring parts and an inner finger wearing ring of the finger spinner ring according to the above preferred embodiment of the present invention.

As shown in FIG. 20 of the drawings, the coupling mechanisms 122 are omitted, and the two ring parts 121 are rotatably surround the outer circumferential surface 112 of the inner finger wearing ring 11 and just have frictional contact with the outer circumferential surface 112 of the inner finger wearing ring 11.

In this embodiment, the inner finger wearing ring 11 comprises a ring body 113 and a circumferential step 114 which is integrally protruded at an outer side of the ring body 113 at a middle area thereof, and thus two indented grooves 115 are formed at two opposite sides of the circumferential step 114.

The outer circumferential surface 112 of the inner finger wearing ring 11 comprises two first circumferential surface portions 1121 formed on the ring body 113 and a second circumferential surface portion 1122 formed on the circumferential step 114 which is at a position higher than the two first circumferential surface portions 1121. An outer diameter of the second circumferential surface portion 1122 on the circumferential step 114 is larger than an outer diameter of each of the two first circumferential surface portions 1121 formed on the ring body 113.

Each of the two ring parts 121 has an inner channel 123 for disposing and accommodating a portion of the inner finger wearing ring 11 and comprises a ring member 1211 having an inner circumferential wall 12111 and an outer circumferential wall 12112, and a protrusion ring 1212 which is integrally protruded from the ring member 1211 and extended into the inner channel 123. The protrusion ring 1212 has a step circumferential wall 12121 which has an inner diameter smaller than an inner diameter of the inner circumferential wall 12111 of the ring member 1211. The inner circumferential wall 12111 of the ring member 1211 and the step circumferential wall 12121 of the protrusion ring 1212 together form the inner circumferential surface of each ring part 121.

In this embodiment, a circumferential groove 1213 is formed between the inner circumferential wall 12111 of the ring member 1211 and the protrusion ring 1212 for accommodating a portion of the circumferential step 114 of the inner finger wearing ring 11. In this way, the circumferential step 114 is partially embedded in the circumferential groove 1213 to form an interlocking engagement between the inner finger wearing ring 11 and each ring part 121.

Figure 3:
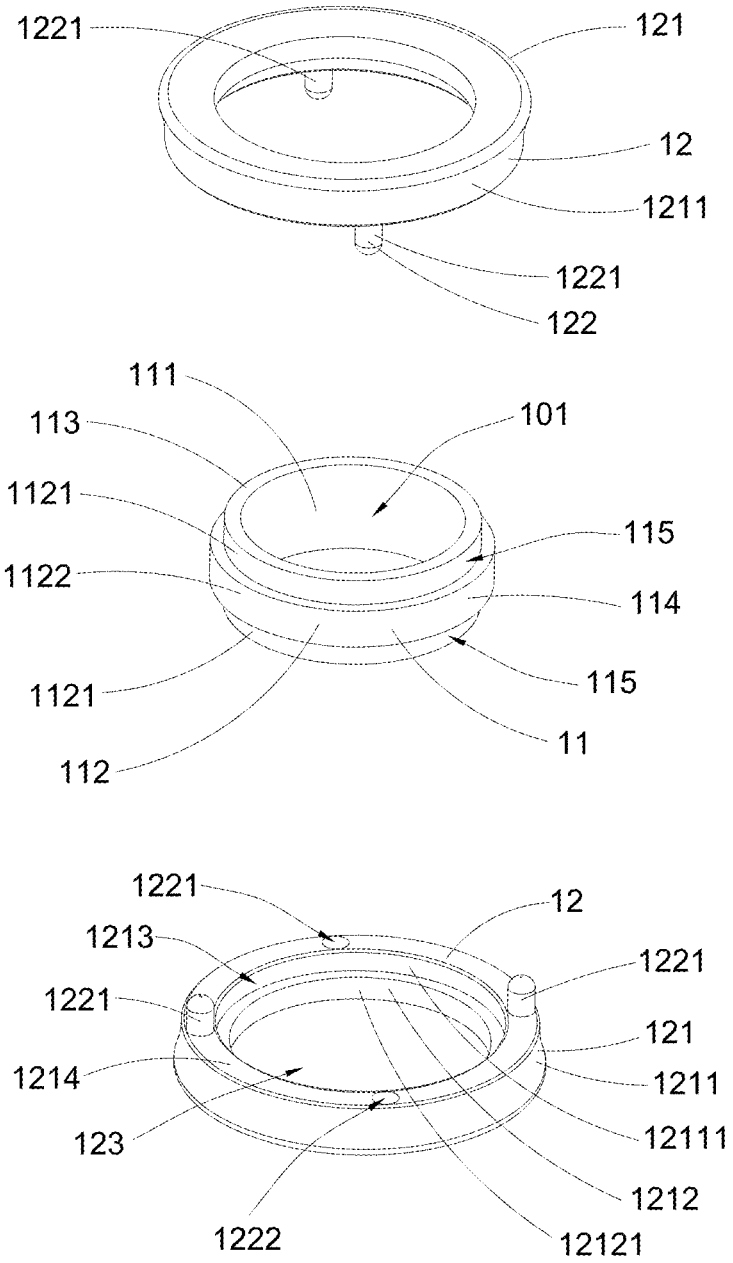
FIG. 3 is an exploded view of an inner rolling ring of the finger spinner ring according to the above preferred embodiment of the present invention.
Figure 4:
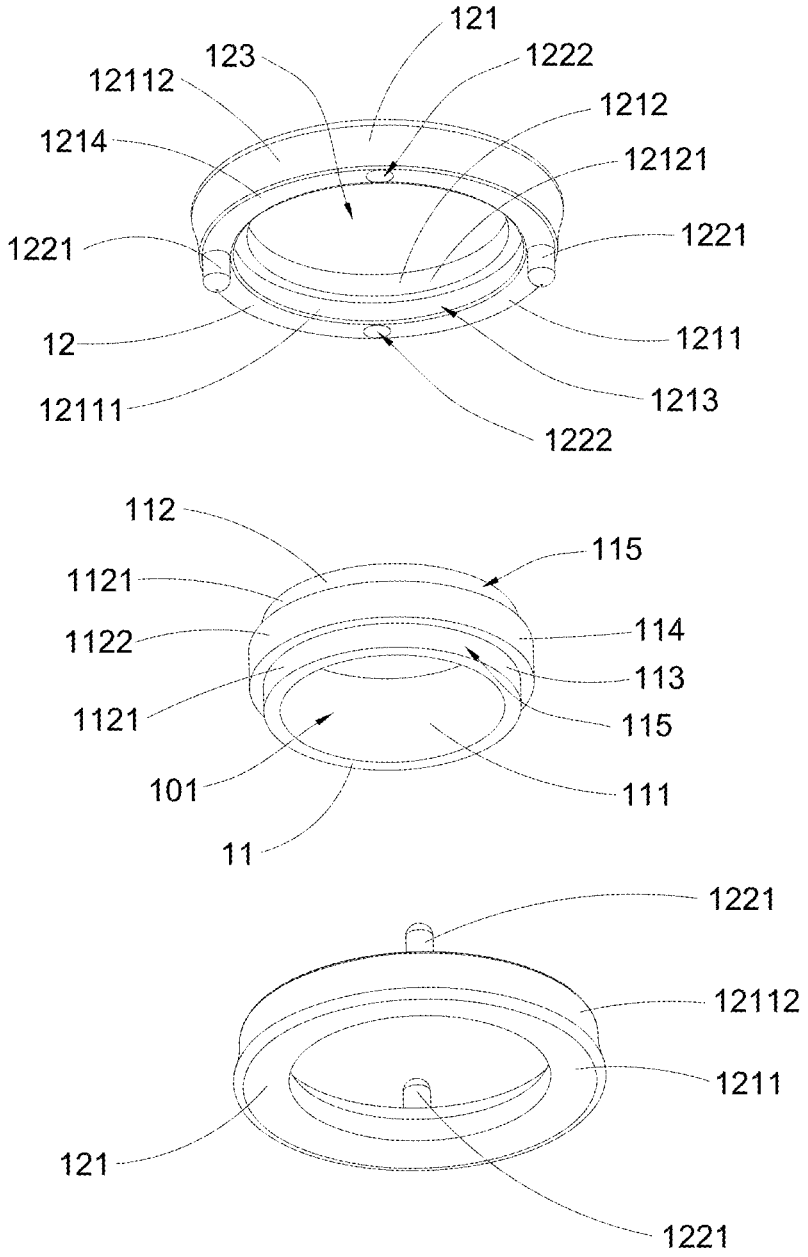
FIG. 4 is another exploded view of an inner rolling ring of the finger spinner ring according to the above preferred embodiment of the present invention.

As shown in FIGS. 3 to 5 of the drawings, a first circumferential gap 124 is formed between the step circumferential wall 12121 of the protrusion ring 1212 of each ring part 121 and the first circumferential surface portion 1121 formed on the ring body 113 of the inner finger wearing ring 11 when each ring part 121 is assembled with the inner finger wearing ring 11. Preferably, a second circumferential gap 125 is formed between the inner circumferential wall 12111 of the ring member 1211 of each ring part 121 and the second circumferential surface portion 1122 on the circumferential step 114 of the inner finger wearing ring 11 when each ring part 121 is assembled with the inner finger wearing ring 11. The first circumferential gap 124 and the second circumferential gap 125 allow the two ring parts 121 to rotate smoothly around the inner finger wearing ring 11, while the circumferential step 114 retained within the circumferential groove 1213 provides axial positioning and prevents detachment of the ring parts 121.

Preferably, As shown in FIGS. 7 and 8 of the drawings, the inner finger wearing ring 11 and the two ring parts 121 are arranged with a circumferential clearance 127 defined therebetween. The circumferential clearance 127 provides a clearance space which allows the two ring parts 121 to rotate smoothly with respect to the inner finger wearing ring 11 without generating excessive friction or interference. At the same time, the circumferential clearance 127 avoids overly tight contact that may otherwise hinder rotation, while still maintaining the positional stability of the outer ring element 12 around the inner finger wearing ring 11. The circumferential clearance 127 includes one or more of the first circumferential gap 124 formed between the step circumferential wall 12121 of the protrusion ring 1212 of each ring part 121 and the first circumferential surface portion 1121 formed on the ring body 113 of the inner finger wearing ring 11, the second circumferential gap 125 formed between the inner circumferential wall 12111 of the ring member 1211 of each ring part 121 and the second circumferential surface portion 1122 on the circumferential step 114 of the inner finger wearing ring 11, and third circumferential gaps 126 between the circumferential step 114 and the two protrusion rings 1212.

When the two ring parts 121 are assembled on the inner finger wearing ring 11, the two protrusion rings 1212 of the two ring parts 121 are located at two opposite sides of the circumferential step 114, so that inner end walls of the two protrusion rings 1212 of the two ring parts 121 at the two opposite sides of the circumferential step 114 are able to prevent the two ring parts 121 from being easy to detach from the inner finger wearing ring 11. In this manner, the inner end walls of the two protrusion rings 1212 confront the circumferential step 114 from both sides, thereby forming an axial constraint. In other words, such a configuration prevents the two ring parts 121 from being easily detached or displaced from the inner finger wearing ring 11, while still allowing the two ring parts 121 to rotate smoothly around the circumferential step 114.

Accordingly, the configuration of the circumferential step 114 of the inner finger wearing ring 11 in cooperation with the circumferential groove 1213 of each ring part 121 provides multiple advantages. The circumferential step 114 received in the circumferential groove 1213 establishes an axial positioning effect, thereby preventing the two ring parts 121 from sliding off or disengaging from the inner finger wearing ring 11 during use. The provision of the first and second circumferential gaps 124 and 125 ensures that the two ring parts 121 are able to rotate smoothly and freely relative to the inner finger wearing ring 11 with minimal frictional resistance, enhancing the spinning performance. This stepped interlocking design distributes the contact load between the inner finger wearing ring 11 and the outer ring element 12, thereby improving structural stability and durability. Furthermore, the recessed engagement formed by the circumferential step 114 and the circumferential groove 1213 minimizes the exposure of sharp or protruding edges, thus enhancing user safety, which is especially important when the inner finger wearing ring 11 is intended for children. Overall, this stepped and grooved engagement provides a balanced combination of secure retention and smooth rotational movement, overcoming the drawbacks of conventional snap-fit or press-fit structures that may either loosen over time or hinder smooth rotation.

Each ring part 121 comprise an inner circumferential end wall 1214, each of the first coupling elements 1221 and the second coupling elements 1222 are disposed on the inner circumferential end wall 1214. When the two ring parts 121 are sleeved on the inner finger wearing ring 11, the first coupling elements 1221 and the second coupling elements 1222 are located at the outer side of the inner finger wearing ring 11. In this way, the coupling engagement between the two ring parts 121 is maintained securely, while the smooth rotational movement of the two ring parts 121 with respect to the inner finger wearing ring 11 remains unaffected.

Each ring part 121 comprise an outer circumferential end wall 1215 which is a curved surface, along the radial direction away from the inner finger wearing ring 11, the outer circumferential end wall 1215 is gradually protruding. The gradually protruding curved design of the outer circumferential end wall 1215 creates a smooth and continuous contour that enhances tactile comfort and rolling experience, while also improving the overall aesthetic appearance of the finger spinner ring.

In this embodiment, the circumferential step 114 comprises two step portions 1141 along the axial directions. When the two ring parts 121 are sleeved on the inner finger wearing ring 11, the two inner circumferential walls 12111 of the two ring members 1211 of the two ring parts 121 are surrounding the two step portions 1141 of the circumferential step 114. In this manner, the two step portions 1141 are axially confined within the inner circumferential walls 12111 of the two ring parts 121, thereby preventing axial displacement of the two ring parts 121 and ensuring that the outer ring element 12 remains securely mounted on the inner finger wearing ring 11 while still allowing rotational movement.

As shown in FIGS. 3 to 5 and 7 of the drawings, each outer circumferential wall 12112 of the ring member 1211 of each ring part 121 is a curvedsurface, the two outer circumferential walls 12112 of the two ring members 1211 of the two ring parts 121 are fitted to each other to define the outer surface 102 of the inner rolling ring 10, so as to form the concave groove 103 of the inner rolling ring 10.

The structure in which two curved surfaces are joined to form the concave groove 103 provides multiple advantages. The smooth transition between the curved surfaces eliminates sharp edges, ensuring uniform stress distribution and improved durability while avoiding crack initiation. This configuration also enhances user comfort by delivering a soft tactile feel and prevents discomfort during wear or use. From a manufacturing perspective, the concave groove 103 is naturally formed during assembly without the need for additional machining, simplifying production and allowing for better tolerance compensation. Furthermore, the seamless integration of the curved surfaces creates a stable fit, improves overall structural reliability, and contributes to an aesthetically pleasing and streamlined appearance.

Figure 24:
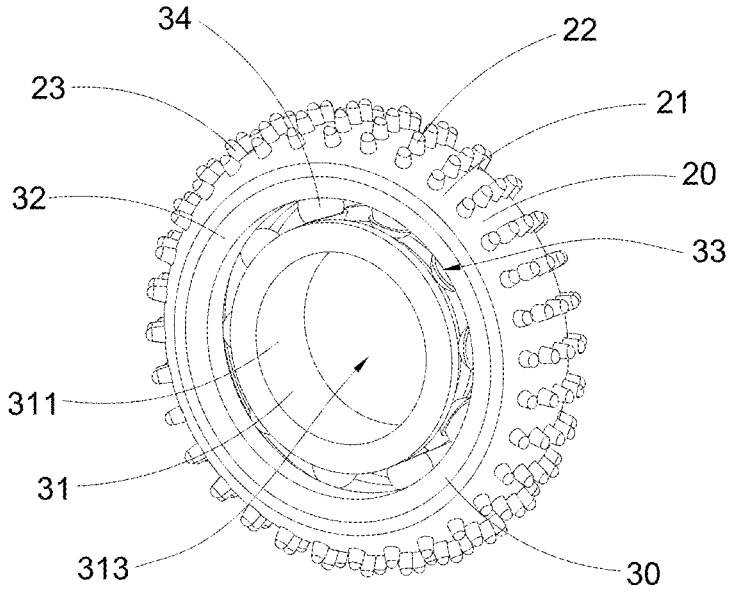
FIG. 24 is a perspective view of a finger spinner ring according to another alternative mode of the above preferred embodiment of the present invention.
Figure 25:
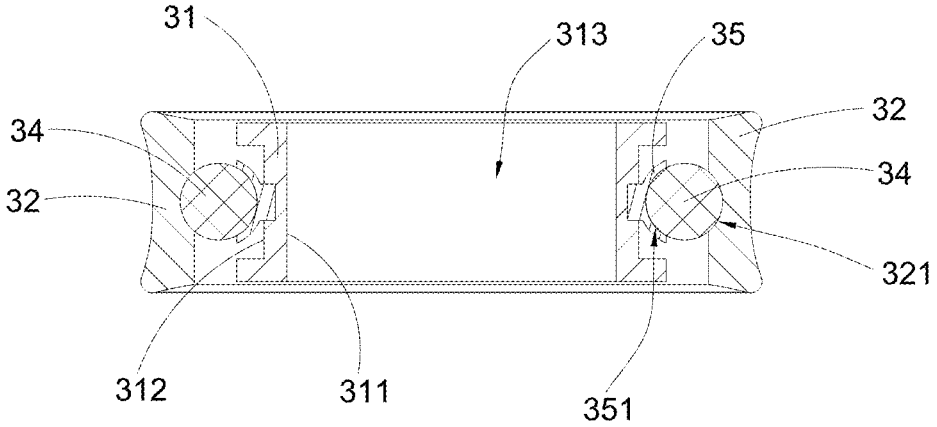
FIG. 25 is a sectional view of an inner rolling ring of the finger spinner ring according to the above another alternative mode of the above preferred embodiment of the present invention.
Figure 26:
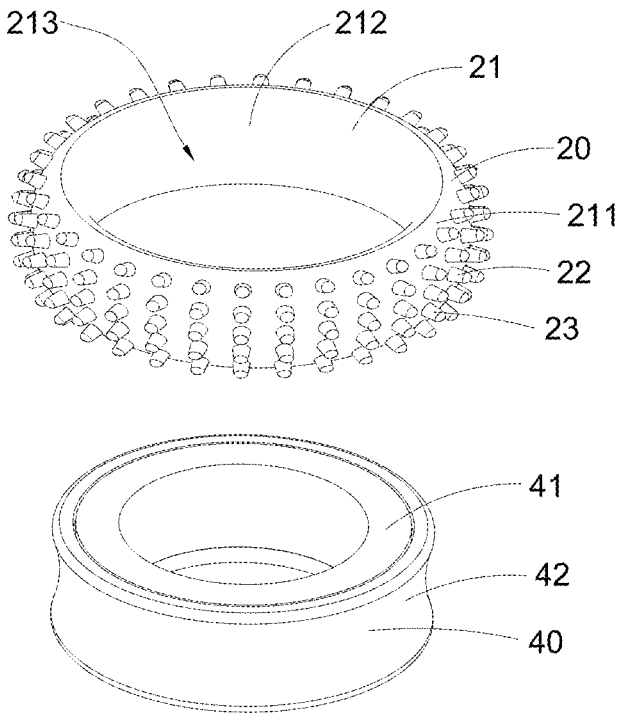
FIG. 26 is an exploded view of a finger spinner ring according to another alternative mode of the above preferred embodiment of the present invention.

Referring to FIGS. 24 to 25 of the drawings, an alternative inner rolling ring 30 comprises an inner finger wearing ring 31 and an outer ring element 32 rotatably coupled to the inner finger wearing ring 31 and surrounding the inner finger wearing ring 31. A circumferential bearing groove 33 is formed between the inner finger wearing ring 31 and the outer ring element 32, and a plurality of bearing balls 34 are disposed in the circumferential bearing groove 33 between the inner finger wearing ring 31 and the outer ring element 32 to allow the rotating movement of the outer ring element 32 with respect to the inner finger wearing ring 31.

The inner finger wearing ring 31 comprises an inner circumferential surface 311 and an outer circumferential surface 312, the inner circumferential surface 311 defines a finger passage 313 for holding the wearing finger of the user. The inner rolling ring 30 comprises a guide rail 35 provided on the outer circumferential surface 312, the guide rail 35 has a circumferential guiding groove 351 for accommodating a side portion of each bearing ball 34. The outer ring element 32 also has an indented circumferential groove 321 for accommodating another side portion of each bearing ball 34.

The use of bearing balls 34 within the circumferential bearing groove 33 which functions as a circumferential clearance significantly reduces rotational friction, enabling smoother, more stable, and more durable rotation of the outer ring element 32 with respect to the inner finger wearing ring 31. This design also provides higher load-bearing capacity and better wear resistance, minimizing long-term deformation or loosening that may occur in purely surface-to-surface contact structures. The dual-groove configuration comprising the circumferential guiding groove 351 at the outer side of the inner finger wearing ring 31 and the indented circumferential groove 321 at the inner side of the outer ring element 32 securely holds the bearing balls 34 in position, thereby enhancing structural reliability and preventing detachment during repeated use. This arrangement also achieves a precise and consistent rolling experience, which improves user comfort and tactile satisfaction when the finger spinner ring is used as a fidget toy.

Referring to FIGS. 26 to 29 of the drawings, another alternative inner rolling ring 40 comprises an inner finger wearing ring 41 and an outer ring element 42 rotatably coupled to the inner finger wearing ring 41 and surrounding the inner finger wearing ring 41.

In this embodiment, the inner finger wearing ring 41 comprises a first inner ring component 411 and a second inner ring component 412 which are sleeved with each other to define a retaining groove 413 for rotatably mounting the outer ring element 42.

More specifically, the first inner ring component 411 comprises a first inner ring body 4111 having a finger passage 4112, and a first circumferential flange 4113 integrally extended from an end of the first inner ring body 4111. The second inner ring component 412 comprises a second inner ring body 4121 and a second circumferential flange 4123 integrally extended from an end of the second inner ring body 4121. An outer diameter of the first inner ring body 4111 is slightly smaller than an inner diameter of the second inner ring body 4121, so as to allow the second inner ring body 4121 to be sleeved on the first inner ring body 4111, so as to define the retaining groove 4113 between the first circumferential flange 4113 and the second circumferential flange 4123 at an outer side of the second inner ring body 4121.

The second inner ring body 4121 has a smooth circumferential surface for engaging with an inner circumferential surface of the outer ring element 42, so as to allow the outer ring element 42 to smoothly rotate around the inner finger wearing ring 41.

Figure 27:
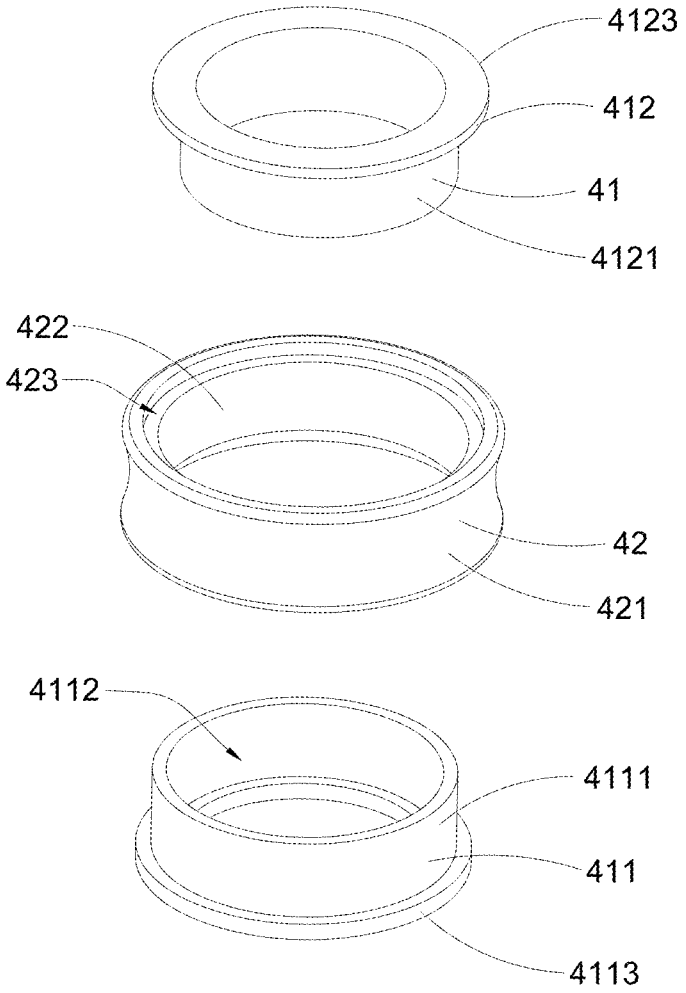
FIG. 27 is an exploded view of an inner rolling ring of the finger spinner ring according to the above another alternative mode of the above preferred embodiment of the present invention.
Figure 28:
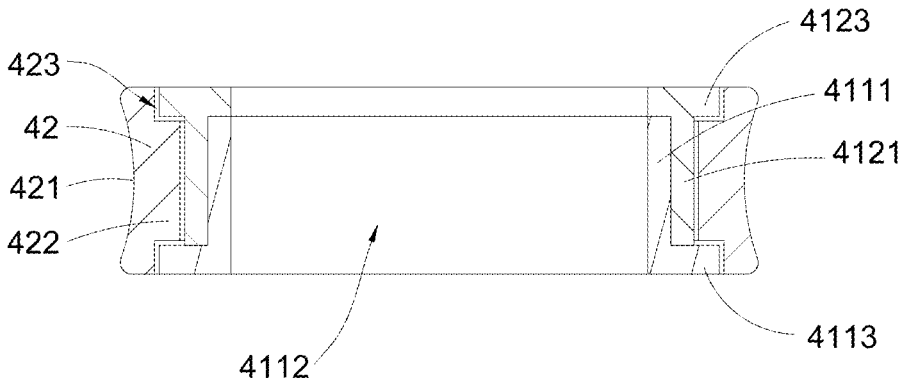
FIG. 28 is a sectional view of the finger spinner ring according to the above another alternative mode of the above preferred embodiment of the present invention.
Figure 29:
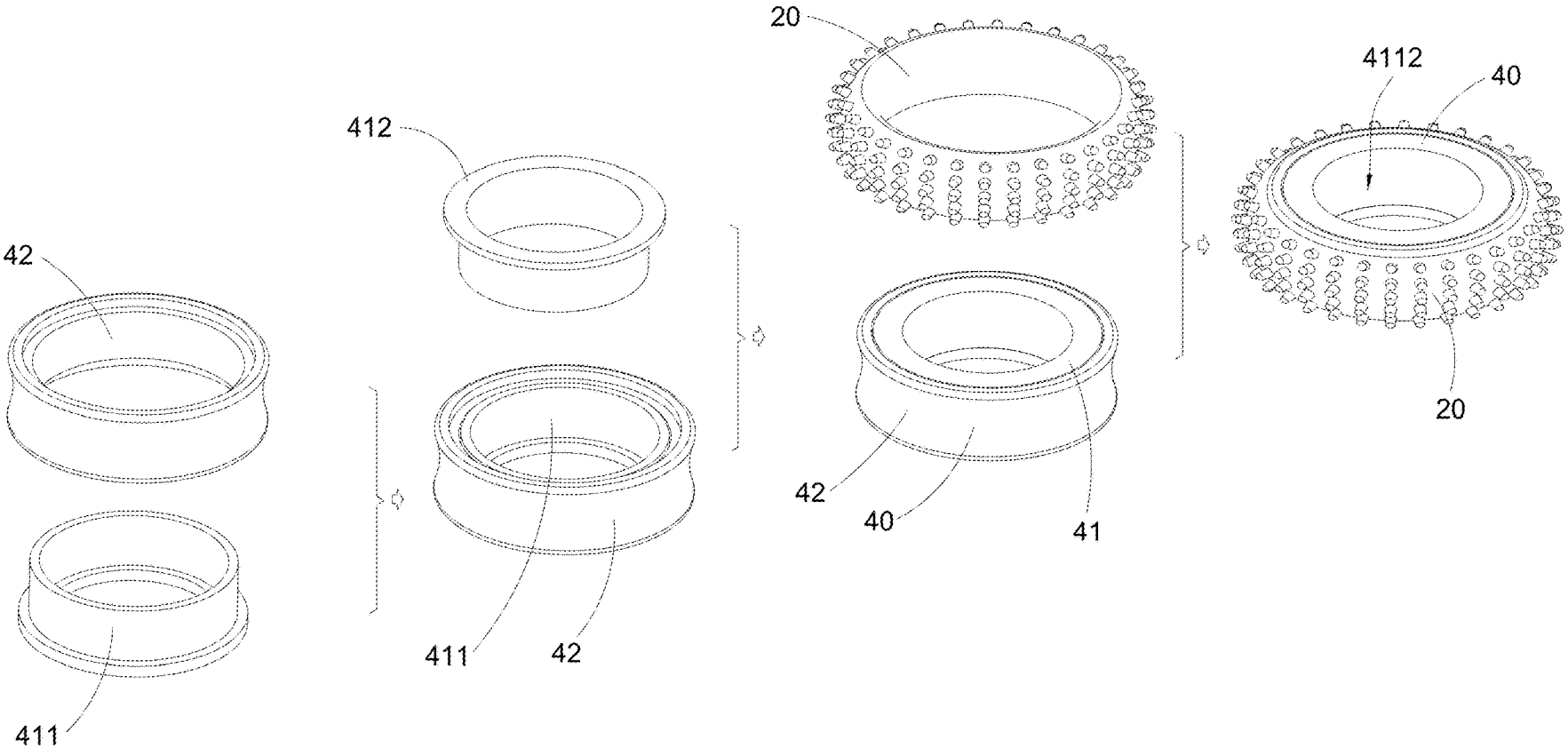
FIG. 29 is schematic view illustrating the assembling process of the finger spinner ring according to the above another alternative mode of the above preferred embodiment of the present invention.

As shown in FIGS. 27 to 28 of the drawings, the outer ring element 42 comprises a ring portion 421 and a retaining portion 422 protruded from a middle of the ring portion 421 at an inner side of the outer ring portion 421, two side grooves 423 are formed at two sides of the retaining portion 422. When the outer ring element 42 is assembled on the inner finger wearing ring 41, the retaining portion 422 is retained at the retaining groove 4113, the the first circumferential flange 4113 and the second circumferential flange 4123 are respectively located at the two side grooves 423 of the outer ring element 42, so that the ring portion 421 are covered on the first circumferential flange 4113 and the second circumferential flange 4123.

This alternative inner rolling ring 40 introduces a two-piece assembly design for the inner finger wearing ring 41, which offers several structural and functional advantages. By dividing the inner finger wearing ring into the first inner ring component 411 and the second inner ring component 412, the retaining groove 413 can be conveniently formed between the two circumferential flanges 4113 and 4123 without requiring complex machining. This groove securely accommodates the outer ring element 42 while still permitting its free rotation, thereby balancing stability and mobility. The sleeved configuration of the first inner ring body 4111 and the second inner ring body 4121 ensures precise alignment, while their size relationship (slightly smaller outer diameter vs. inner diameter) simplifies assembly and prevents excessive looseness. Additionally, the smooth circumferential surface of the second inner ring body 4121 in contact with the outer ring element 42 minimizes friction, enabling smooth and quiet rotational movement. This structure not only enhances manufacturing feasibility but also improves durability and user comfort compared with single-body or more intricate bearing designs.

This two-component design of the inner rolling ring 40 also makes the overall structure lighter and thinner while maintaining strength, since the retaining groove 413 is naturally defined by the cooperative engagement of the first inner ring component 411 and the second inner ring component 412, without requiring extra bulky parts. The sleeved configuration also simplifies assembly, as the two ring components can be easily fitted together to secure the outer ring element 42, avoiding complicated installation steps. As a result, the structure is not only slim and lightweight, improving wearing comfort for long-term use, but also user-friendly in production and assembly.

Figure 30:
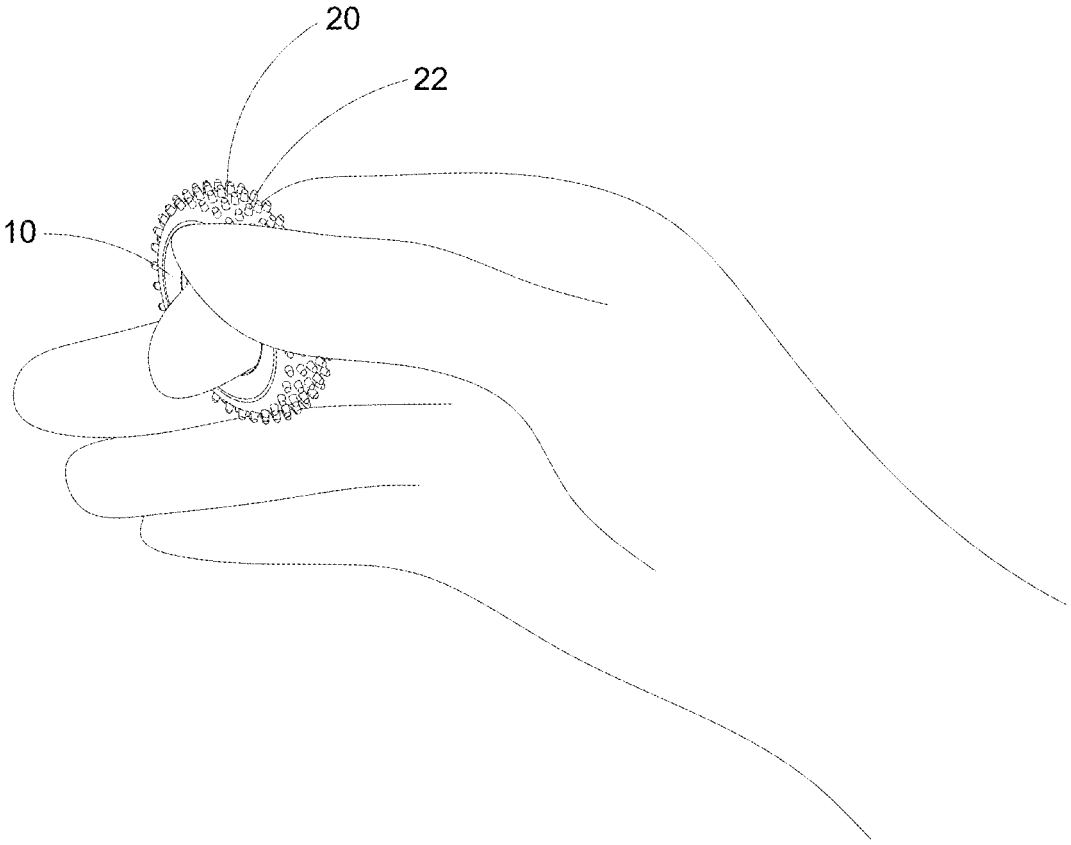
FIG. 30 is a perspective view illustrating the finger spinner ring being worn on a wearing finger of the user.

As shown in FIG. 30 of the drawings, an application scenario of the finger spinner ring is illustrated in which the ring is worn on the user's index finger, serving as the wearing finger, while the user's thumb is placed on the outer flexible ring 20 to perform a rolling operation. During this rolling motion, the user can experience enhanced tactile stimulation due to the texture pattern 23 of the outer flexible ring 20, which can include conical, circular, axial, or circumferential protrusions. This tactile feedback provides a sensory engagement that can be calming and help improve focus, making the finger spinner ring suitable for children, teens, or adults who require stress relief or a tool to occupy restless fingers. Additionally, the smooth rolling motion of the outer flexible ring 20 along the inner rolling ring 10 delivers a pleasant kinetic interaction, offering entertainment value and encouraging repeated use. The combination of wearable convenience, rotational motion, and customizable textured surfaces allows the device to serve both therapeutic and recreational functions, enhancing its overall utility compared with conventional fidget toys.

Figure 31:
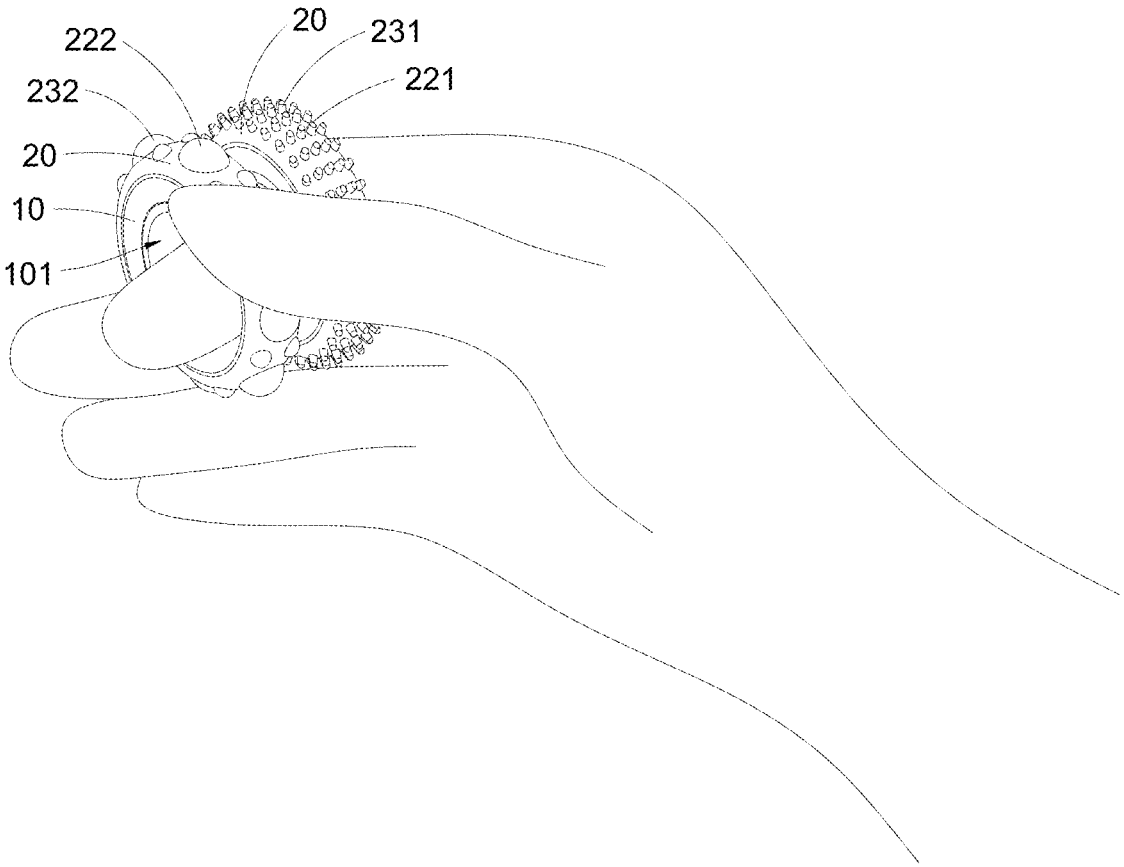
FIG. 31 is a perspective view illustrating two finger spinner rings being worn on a wearing finger of the user.

As shown in FIG. 31 of the drawings, two or more finger spinner rings can be worn simultaneously on the same wearing finger. Each finger spinner ring comprises an outer flexible ring 20, and the outer flexible rings 20 of the multiple finger spinner rings may have different texture patterns 23. This configuration allows the user to experience diverse tactile sensations on a single finger, enhancing sensory stimulation, increasing engagement, and providing a customizable fidgeting experience. By combining different textures, the wearer can alternate between various rolling sensations, further promoting stress relief, focus, and entertainment during use.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A finger spinner ring, comprising:

an inner rolling ring having a finger passage; and an outer flexible ring which is detachably provided on the inner rolling ring and surrounding the inner rolling ring;

wherein the inner rolling ring comprises an inner finger wearing ring having the finger passage and an outer ring element rotatably mounted on the inner finger wearing ring, wherein the outer flexible ring is detachably mounted on the outer ring element for being driven to rotate along with the outer ring element, wherein the outer ring element is located between the inner finger wearing ring and the outer flexible ring.

2. The finger spinner ring according to claim 1, wherein the inner rolling ring comprises an outer surface along a circumferential direction, the outer flexible ring comprises an inner surface which is biasing against the outer surface of the inner rolling ring when the outer flexible ring is detachably mounted on the inner rolling ring.

3. The finger spinner ring according to claim 2, wherein the outer surface of the inner rolling ring defines a concave groove for receiving the inner surface of the outer flexible ring.

4. The finger spinner ring according to claim 3, wherein the outer surface of the inner rolling ring is a curved surface with a diameter gradually decreases toward a middle portion thereof to define the concave groove.

5. The finger spinner ring according to claim 4, wherein an outer diameter of the middle portion of the outer surface of the inner rolling ring is equal to or larger than an inner diameter of the inner surface of the outer flexible ring.

6. The finger spinner ring according to claim 2, wherein the inner rolling ring comprises two protrusion edges integrally protruded from two axial ends of the outer surface of the inner rolling ring to define a concave groove for receiving the inner surface of the outer flexible ring.

7. The finger spinner ring according to claim 2, wherein the inner surface of the outer flexible ring is a circumferential smooth surface.

8. The finger spinner ring according to claim 1, wherein the outer flexible ring comprises an outer ring body comprising an outer surface and a plurality of protrusions integrally extended from the outer surface of the outer ring body.

9. The finger spinner ring according to claim 2, wherein the outer flexible ring comprises an outer ring body comprising an outer surface, a plurality of protrusions integrally extended from the outer surface of the outer ring body, and a plurality of inner protrusions integrally extended from the inner surface of the outer flexible ring.

10. The finger spinner ring according to claim 1, wherein the outer flexible ring is made of a resilient material selected from the group consisting of silicone rubber, thermoplastic elastomer, thermoplastic polyurethane, and thermoplastic rubber, wherein the inner rolling ring is made of plastic.

11. The finger spinner ring according to claim 1, wherein the inner finger wearing ring comprises an outer circumferential surface, wherein the outer ring element is arranged on the inner finger wearing ring to define a circumferential clearance therebetween to allow the outer ring element to be rotatable with respect to the inner finger wearing ring.

12. The finger spinner ring according to claim 11, wherein the outer ring element comprises two ring parts which are rotatably arranged on two axial sides of the inner finger wearing ring, and one or more coupling mechanisms for mounting the two ring parts with each other.

13. The finger spinner ring according to claim 12, wherein the inner finger wearing ring comprises a ring body and a circumferential step which is integrally protruded at an outer side of the ring body at a middle area thereof, wherein two indented grooves are formed at two opposite sides of the circumferential step, wherein the outer circumferential surface of the inner finger wearing ring comprises two first circumferential surface portions formed on the ring body and a second circumferential surface portion formed on the circumferential step, an outer diameter of the second circumferential surface portion on the circumferential step is larger than an outer diameter of each of the two first circumferential surface portions formed on the ring body, each of the two ring parts has an inner channel for disposing and accommodating a portion of the inner finger wearing ring and comprises a ring member having an inner circumferential wall, and a protrusion ring which is integrally protruded from the ring member and extended into the inner channel, wherein the protrusion ring has a step circumferential wall which has an inner diameter smaller than an inner diameter of the inner circumferential wall of the ring member, a circumferential groove is formed between the inner circumferential wall of the ring member and the protrusion ring for accommodating a portion of the circumferential step of the inner finger wearing ring.

14. The finger spinner ring according to claim 13, wherein when the two ring parts are assembled on the inner finger wearing ring, the two protrusion rings of the two ring parts are located at two opposite sides of the circumferential step.

15. The finger spinner ring according to claim 14, wherein each of the two ring parts comprise an inner circumferential end wall, each of the one or more coupling mechanisms comprises a first coupling element and a second coupling elements which are respectively disposed on the inner circumferential end walls of the two ring parts, wherein when the two ring parts are sleeved on the inner finger wearing ring, the first coupling element and the second coupling element are located at an outer side of the inner finger wearing ring.

16. The finger spinner ring according to claim 1, wherein the outer flexible ring comprises a surface texture which comprises one or more of conical protrusions, square protrusions, circular protrusions, axial ribs extending along an axial direction, circumferential ribs extending along a circumferential direction, and thread ribs arranged spirally and circumferentially.

17. A finger spinner ring set, comprising:

an inner rolling ring which is made of a rigid material and comprises an inner finger wearing ring having a finger passage and an outer ring element rotatably mounted on the inner finger wearing ring;

a first outer flexible ring which is capable of being detachably provided on the inner rolling ring for being driven to rotate along with the outer ring element, wherein the first outer flexible ring comprises a first outer ring body and a plurality of first protrusions protruded on the first outer ring body to form a first texture pattern; and a second outer flexible ring which is capable of being detachably provided on the inner rolling ring for being driven to rotate along with the outer ring element, wherein the second outer flexible ring comprises a second outer ring body and a plurality of second protrusions protruded on the second outer ring body to form a second texture pattern which is different from the first texture pattern.

18. A finger spinner ring set, comprising:

a first inner rolling ring which is rigid and comprises a first inner finger wearing ring having a first finger passage and a first outer ring element rotatably mounted on the first inner finger wearing ring;

a first outer flexible ring which is capable of being detachably provided on the first inner rolling ring for being driven to rotate along with the first outer ring element, wherein the first outer flexible ring comprises a first outer ring body and a plurality of first protrusions protruded on the first outer ring body to form a first texture pattern;

a second inner rolling ring which is rigid and comprises a second inner finger wearing ring having a second finger passage and a second outer ring element rotatably mounted on the second inner finger wearing ring; and a second outer flexible ring which is capable of being detachably provided on the second inner rolling ring for being driven to rotate along with the second outer ring element, wherein the second outer flexible ring comprises a second outer ring body and a plurality of second protrusions protruded on the second outer ring body to form a second texture pattern which is different from the first texture pattern.

* * * * *